United States Patent [19]

Oger

[11] 3,946,567

[45] Mar. 30, 1976

[54] VOUSSOIR FOR A LINING, AND METHOD FOR CONSTRUCTING THE LINING

[75] Inventor: Jacques Francois Oger, Pont-A-Mousson, France

[73] Assignee: Pont-A-Mousson S.A., Pont-A-Mousson, France

[22] Filed: Feb. 12, 1974

[21] Appl. No.: 441,927

[30] Foreign Application Priority Data

| | | |
|---|---|---|
| Feb. 19, 1973 | France | 73.05727 |
| Jan. 31, 1974 | France | 74.03310 |

[52] U.S. Cl. ..... 61/45 R; 52/245; 269/285

[51] Int. Cl.[2] ..... E21D 11/22

[58] Field of Search ..... 61/45, 84, 85, 41; 52/245

[56] References Cited

UNITED STATES PATENTS

| | | | |
|---|---|---|---|
| 935,376 | 9/1909 | Lennon | 61/45 |
| 2,046,727 | 7/1936 | Cushwa | 61/45 |
| 2,366,961 | 1/1945 | Fine et al. | 61/45 |
| 3,483,706 | 12/1969 | Taradash | 61/45 |
| 3,695,044 | 10/1972 | Hoshino et al. | 61/45 |
| 3,707,846 | 1/1973 | Leblond et al. | 61/45 |

FOREIGN PATENTS OR APPLICATIONS

| | | | |
|---|---|---|---|
| 689,778 | 6/1964 | Canada | 61/45 |

*Primary Examiner*—Jacob Shapiro

*Attorney, Agent, or Firm*—Sughrue, Rothwell, Mion, Zinn & Macpeak

[57] ABSTRACT

Method for constructing a bore lining comprising pre-assembling in the factory voussoirs into a panel in a jig having the required outside dimensions for the panel by means of a connecting material which fills the gaps between the voussoirs. Each panel has at least two voussoirs which are juxtaposed in at least one of circumferential and axial directions of the panel. The pre-assembled panels are then transferred to the construction site and laid directly in the bore so as to form the lining.

A voussoir for the panel and a jig for assembling the voussoirs into a panel are described.

15 Claims, 36 Drawing Figures

VOUSSOIR FOR A LINING, AND METHOD FOR CONSTRUCTING THE LINING

The present invention relates to a method for constructing a lining from elementary voussoirs, in particular cast iron voussoirs, this lining being intended to line tunnels, wells and like underground works.

Such a method is known, for example from French Patent No. 7,030,289, which comprises pre-assembling in the factory by means of a connecting or bonding material, panels each of which panels comprises at least two voussoirs juxtaposed in at least one of circumferential and axial directions and, after transfer to the construction site, directly laying such pre-assembled panels so as to form the lining.

In such a device, the connecting material merely has a simple adhering function and is provided only in an amount just sufficient for this purpose. The sole advantage that such a pre-assembly seems to afford resides in a certain ease of handling between the factory and the construction site.

Now, in the case of moulded or cast voussoirs, and in particular cast iron voussoirs, owing to the manufacturing tolerances the dimensions obtained by such a pre-assembly in the factory usually differ from the theoretical dimensions for the positioning of the panels in the lining on the construction site and this often requires making a choice between panels before their assembly.

An object of the present invention is to provide a method for constructing linings which avoids these differences in dimensions and thus simplifies the handling and results in an appreciable saving in time.

The invention provides a method of the aforementioned type comprising pre-assembling in the factory each panel in a jig having the required outside dimensions and filling with the connecting material the gaps existing between the voussoirs constituting the panel.

In this way, there is avoided in the factory the clearances which could exist between the assembled voussoirs as result of the manufacturing tolerances. The connection is preferably achieved by adhesion or welding.

An other object of the invention is to provide a pre-assembling jig for carrying out said method.

The invention provides a pre-assembling jig comprising a frame provided with a device for supporting the webs of the voussoirs and having the general shape of a portion of a cylinder, a device for bearing against the walls of the voussoirs and having at least one group of bearing means arranged along two mean planes perpendicular to said cylindrical shape and located at a predetermined distance from each other and a device for spreading apart the voussoirs in the direction of the bearing means.

Another object of the invention is to provide a voussoir for carrying out said method, comprising a web having the general shape of a portion of a cylinder and surrounded by a rectangular frame having walls perpendicular to the web, wherein at least one of parallel pairs of walls of the frame have a circumferential or axial recess for receiving the connecting and filling material.

Further features and advantages of the invention will be apparent from the ensuing description with reference to the accompanying drawings. In the drawings.

Figure 10:
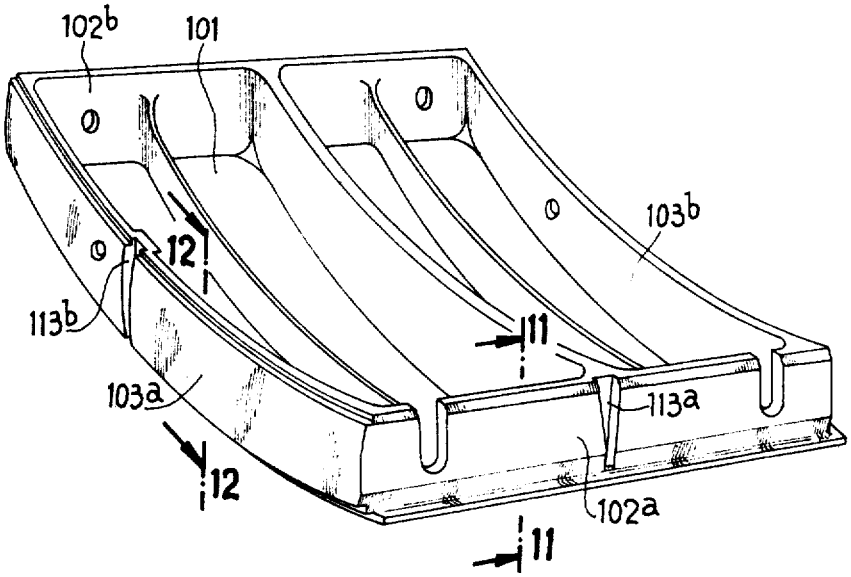
FIG. 10 is a perspective view of a voussoir which is of utility for the construction of a lining with pre-assembly of panels by means of a jig according to the invention.
Figure 11:
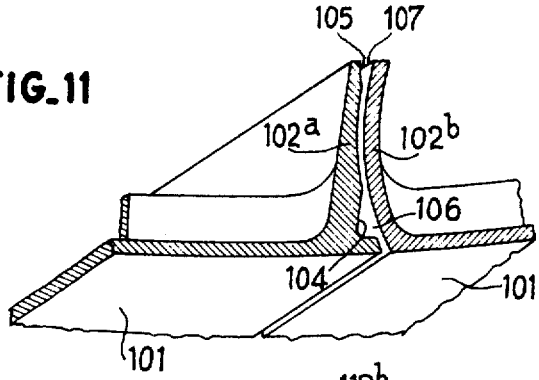
Figure 12:
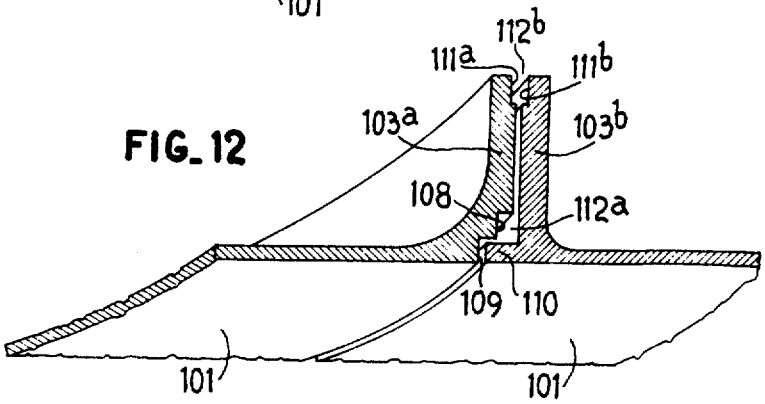
Figure 13:
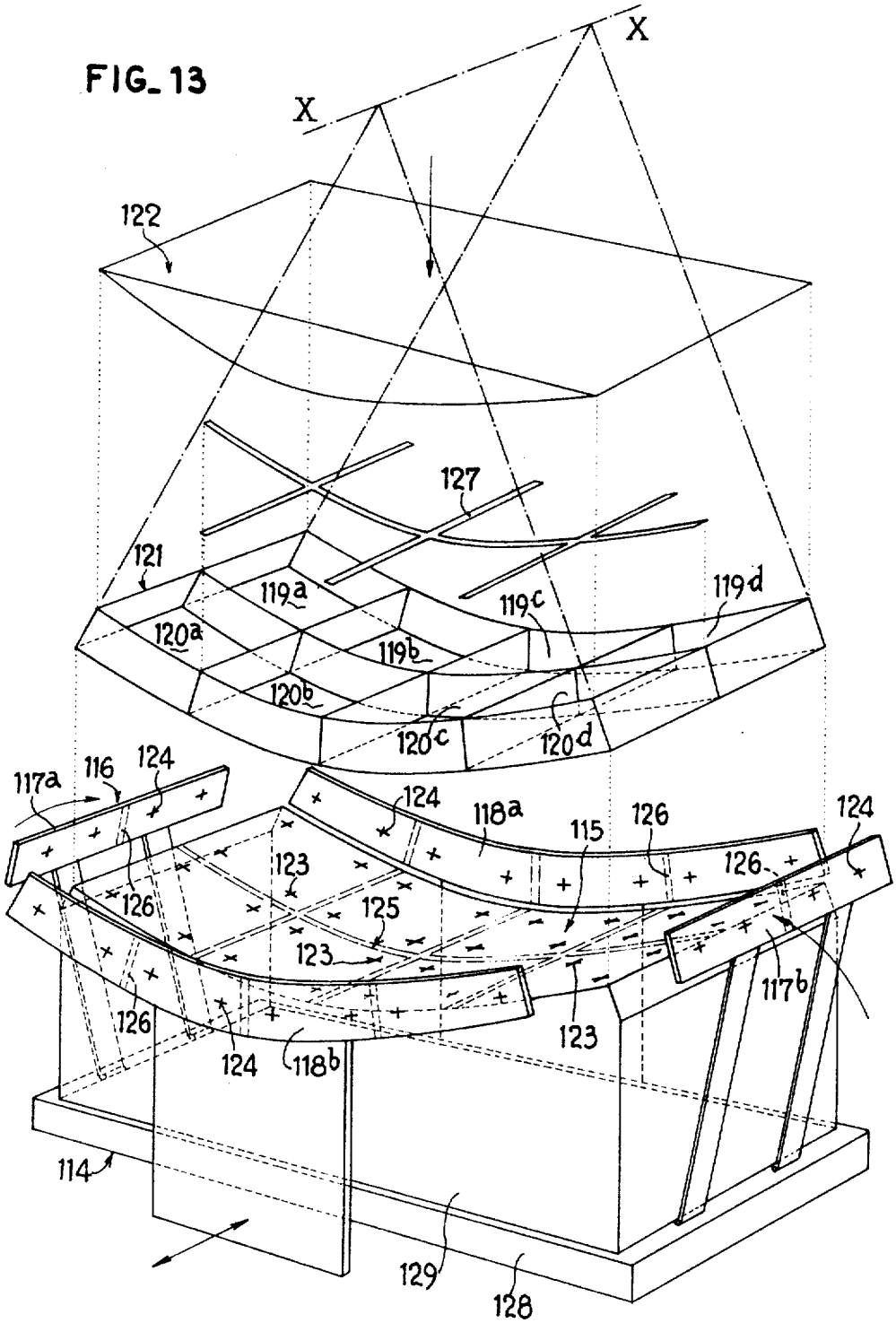
Figure 14:
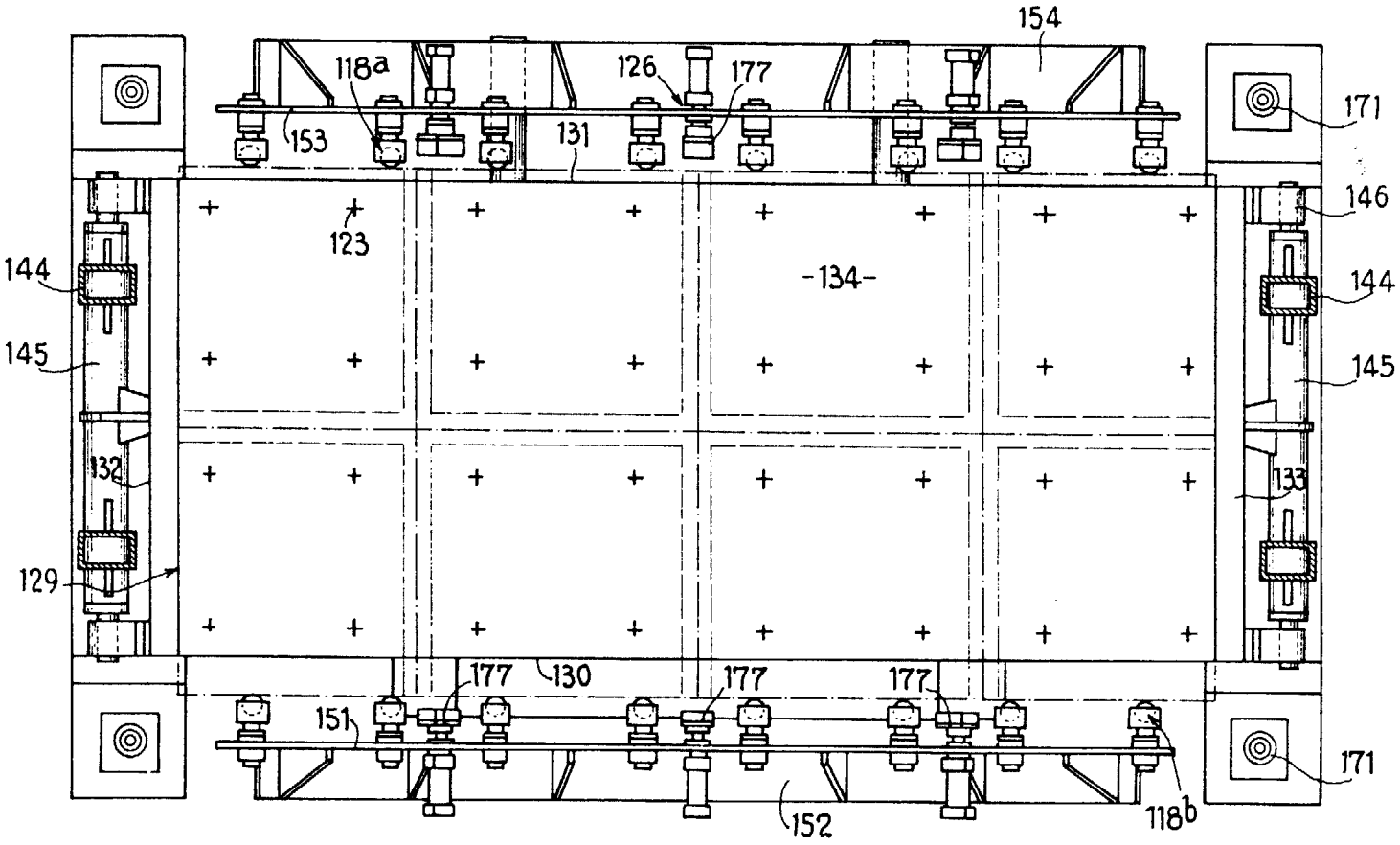
Figure 15:
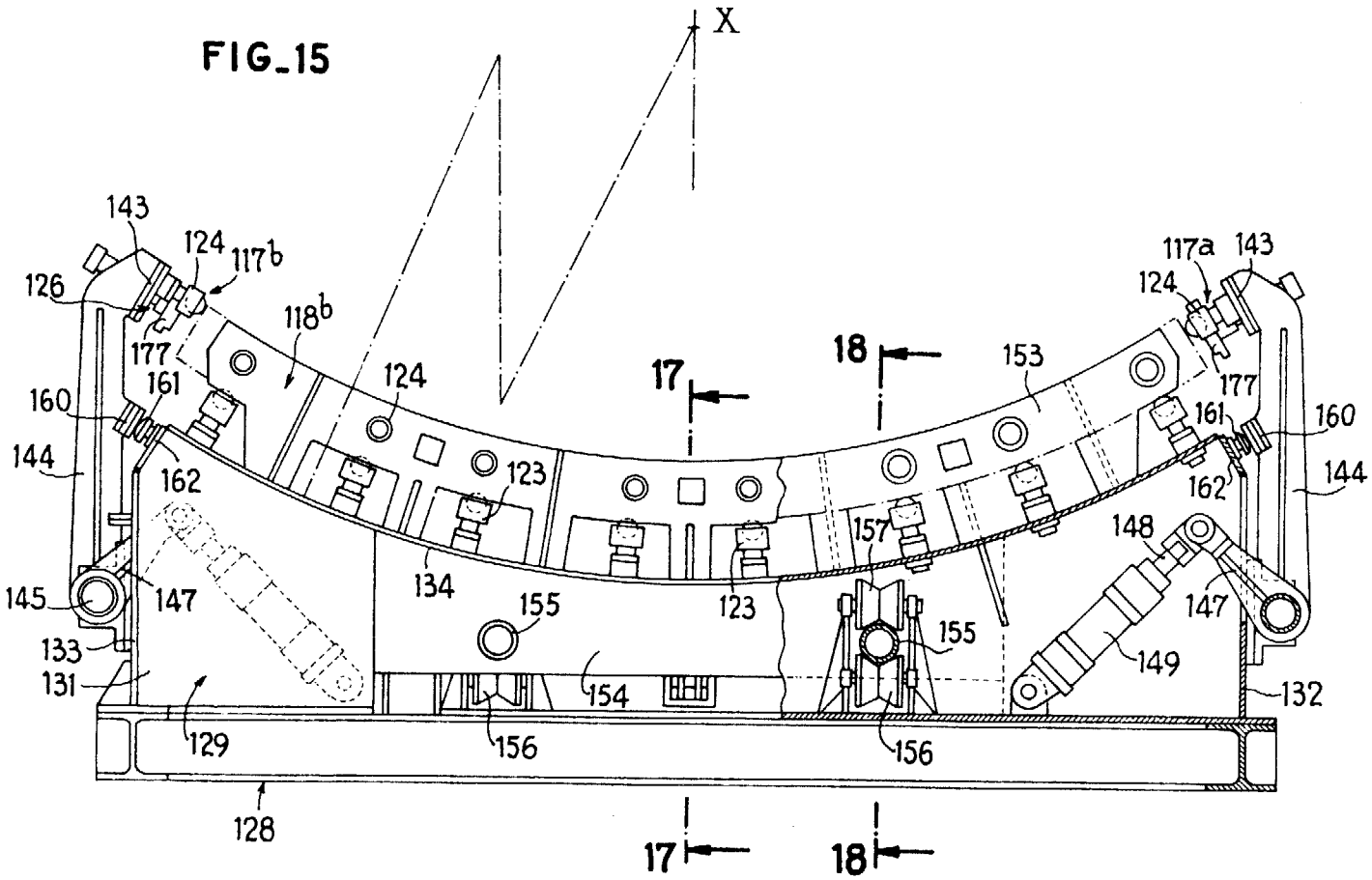
Figure 16:
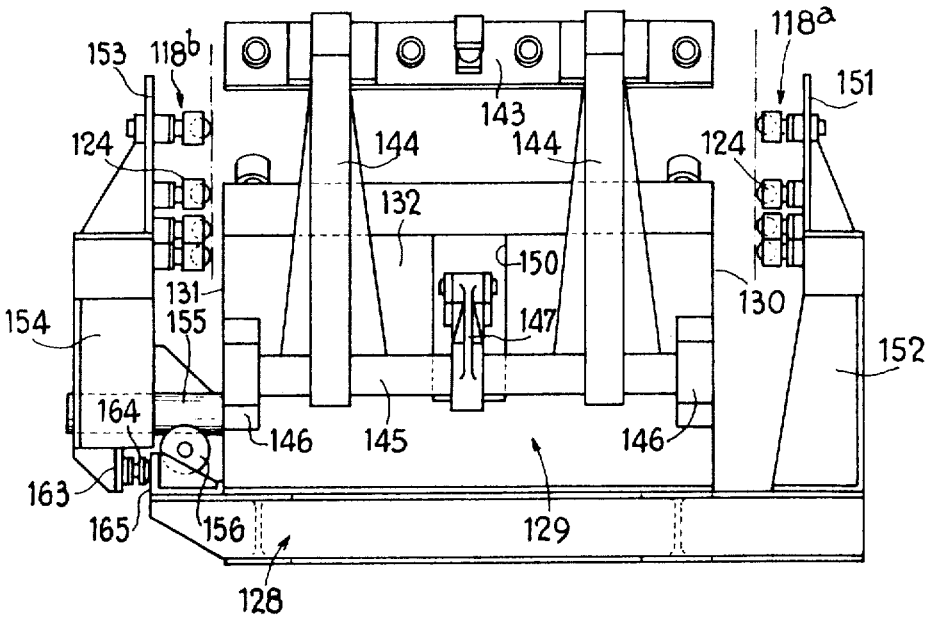
Figure 20:
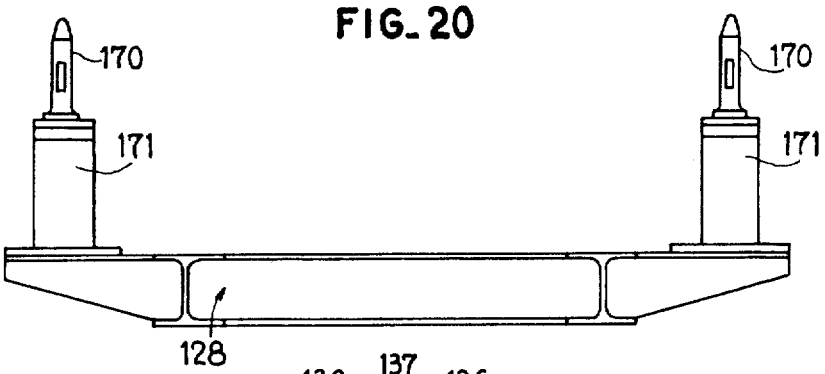
Figure 23:
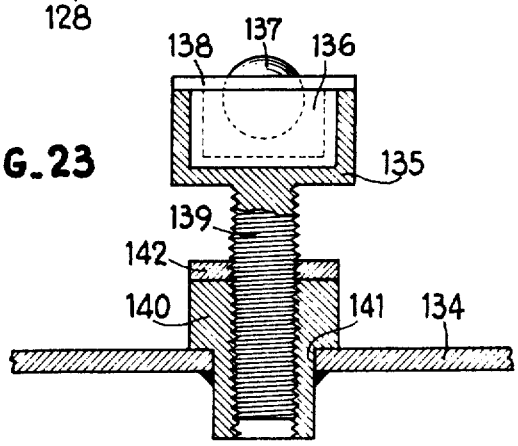
Figure 17:
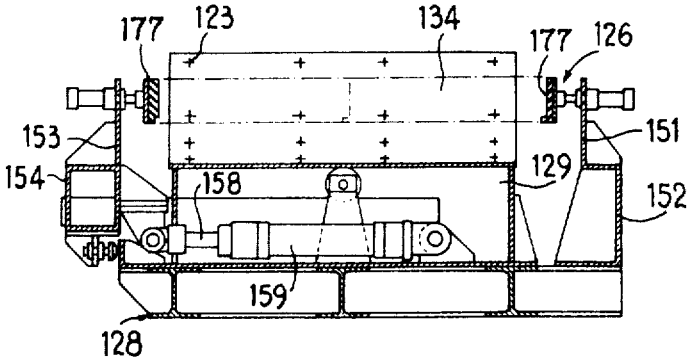
Figure 18:
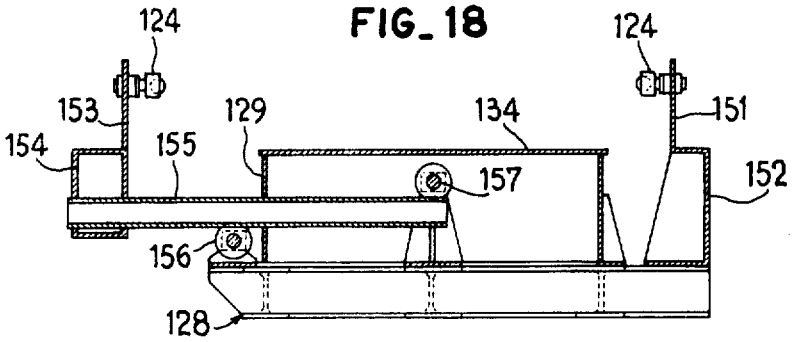
Figure 24:
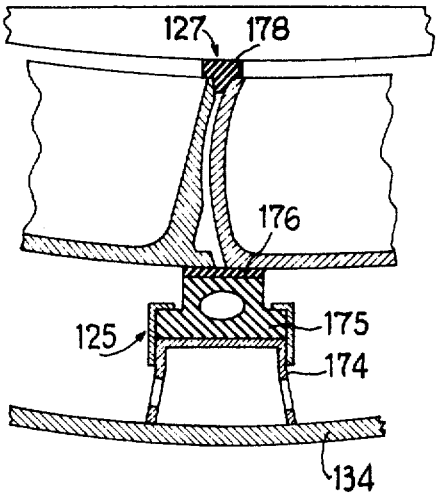
Figure 21:
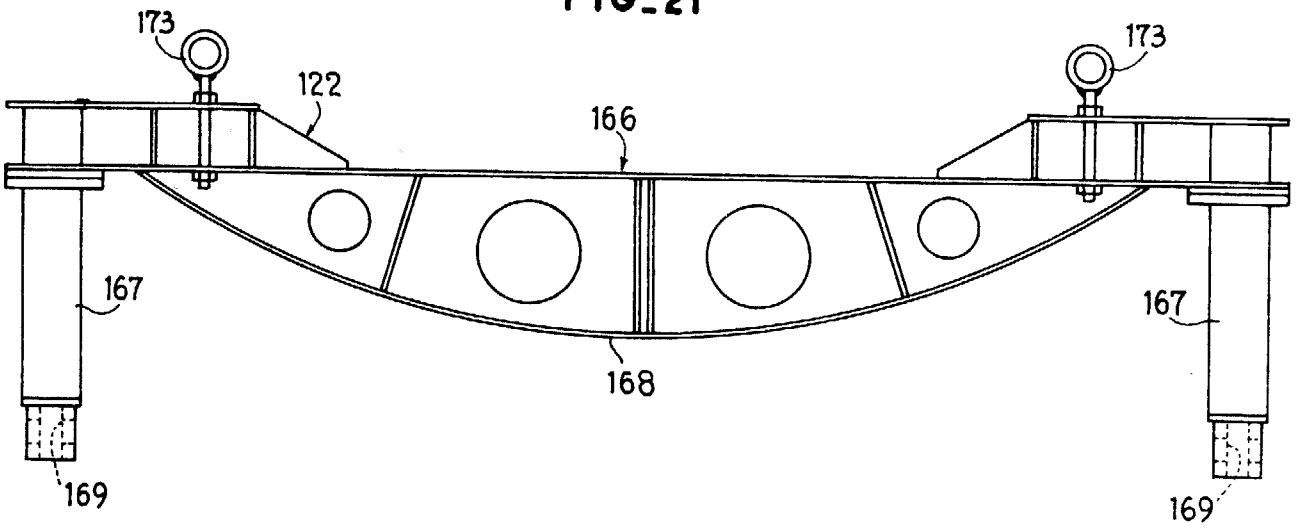
Figure 19:
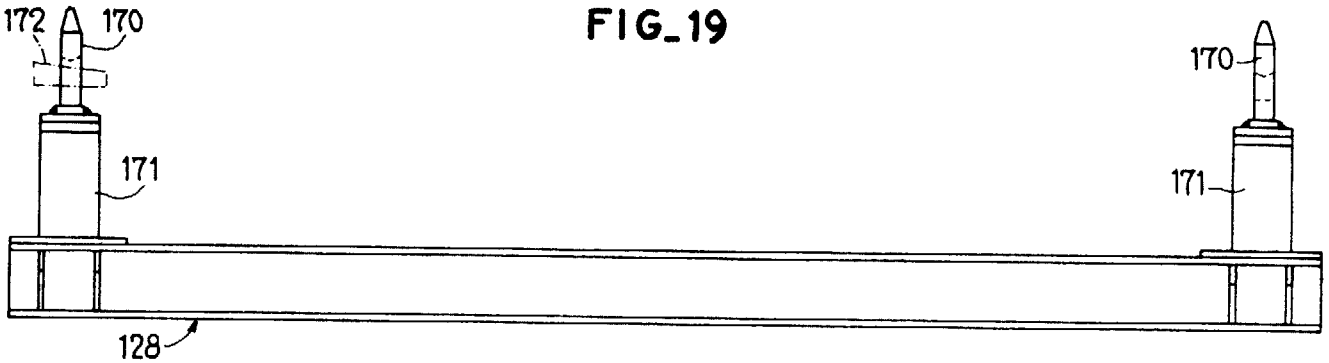
Figure 22:
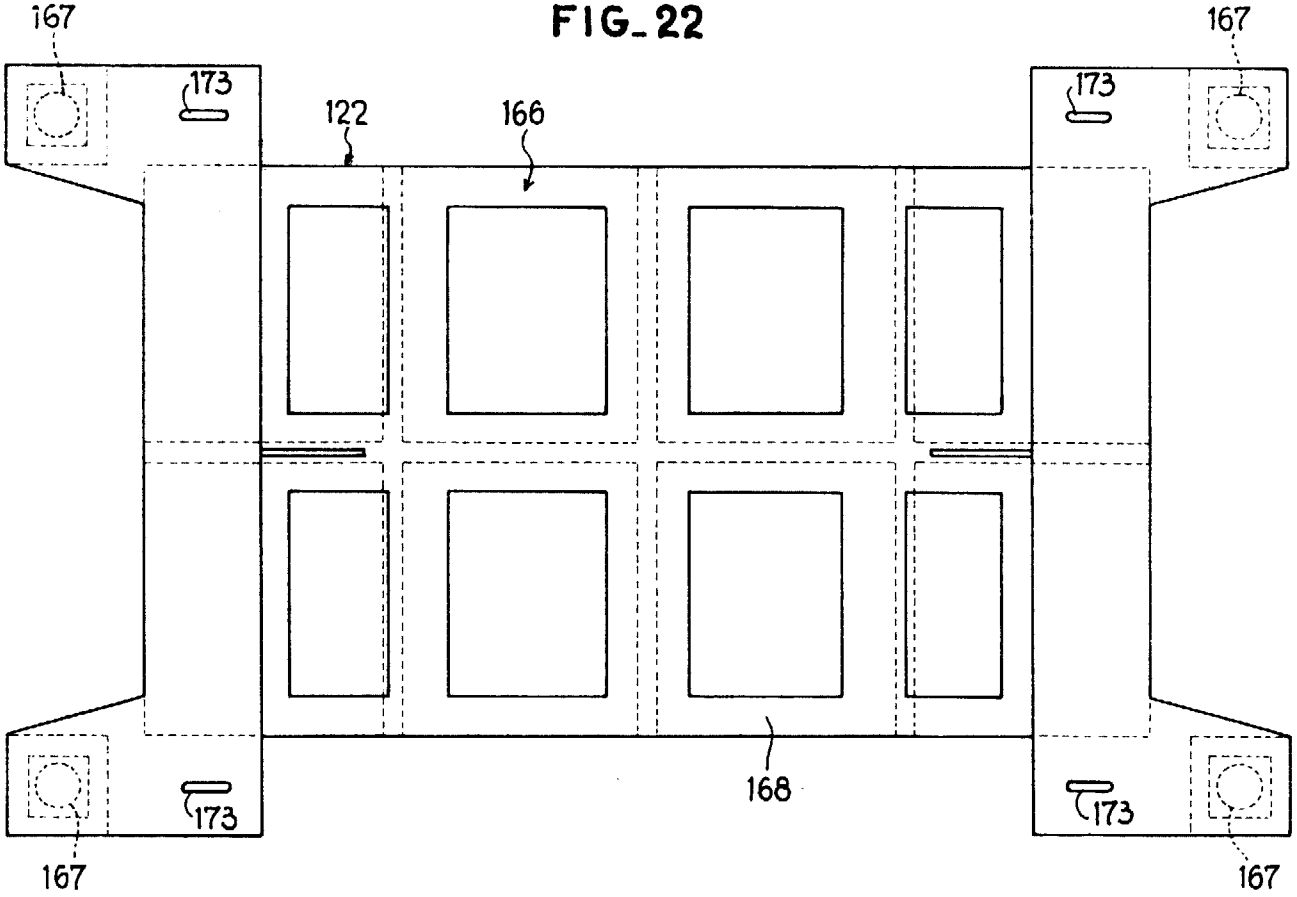
Figure 28:
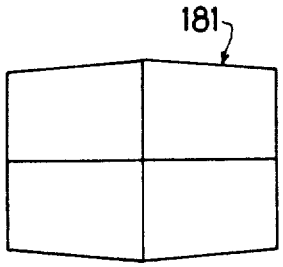
Figure 25:
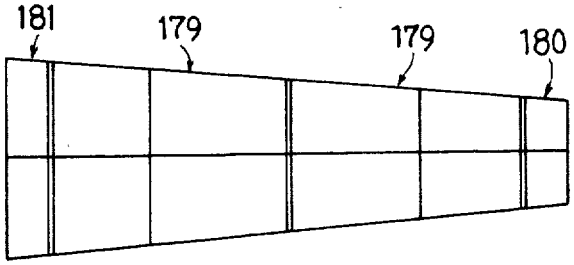
Figure 26:
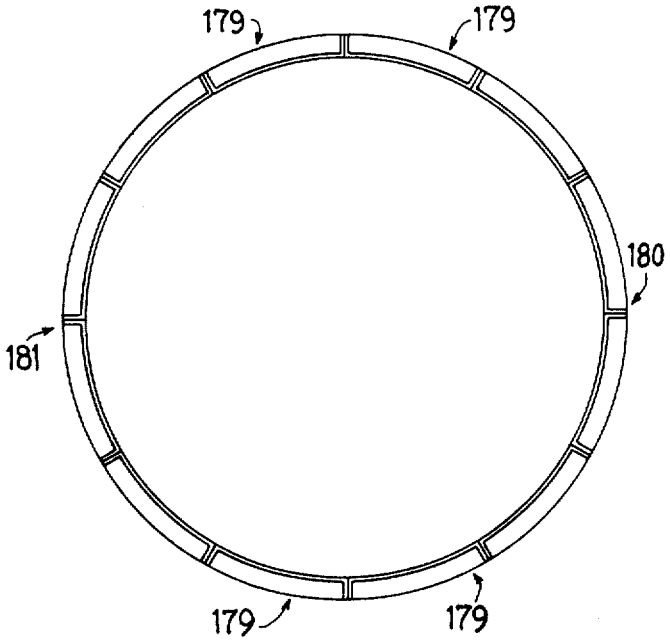
Figure 27:
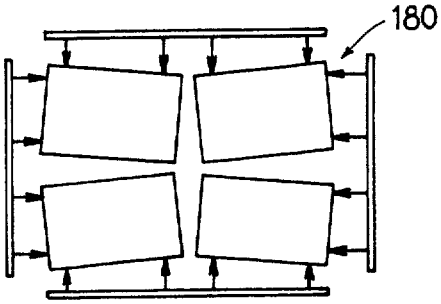
Figure 30:
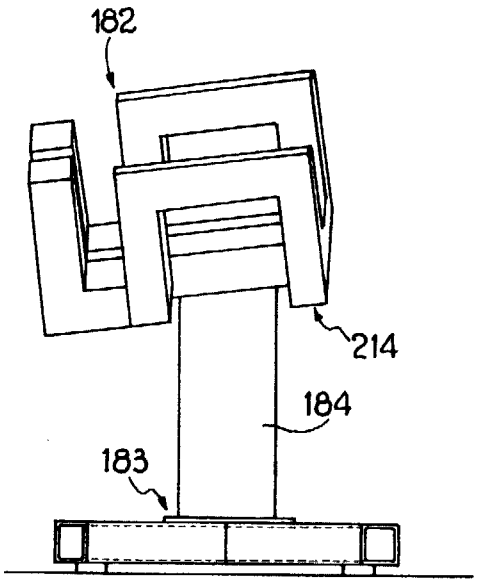
Figure 29:
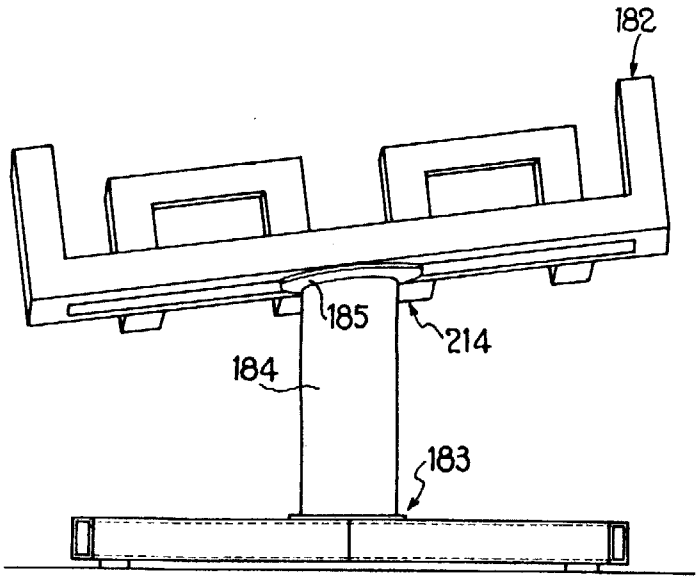
Figure 31:
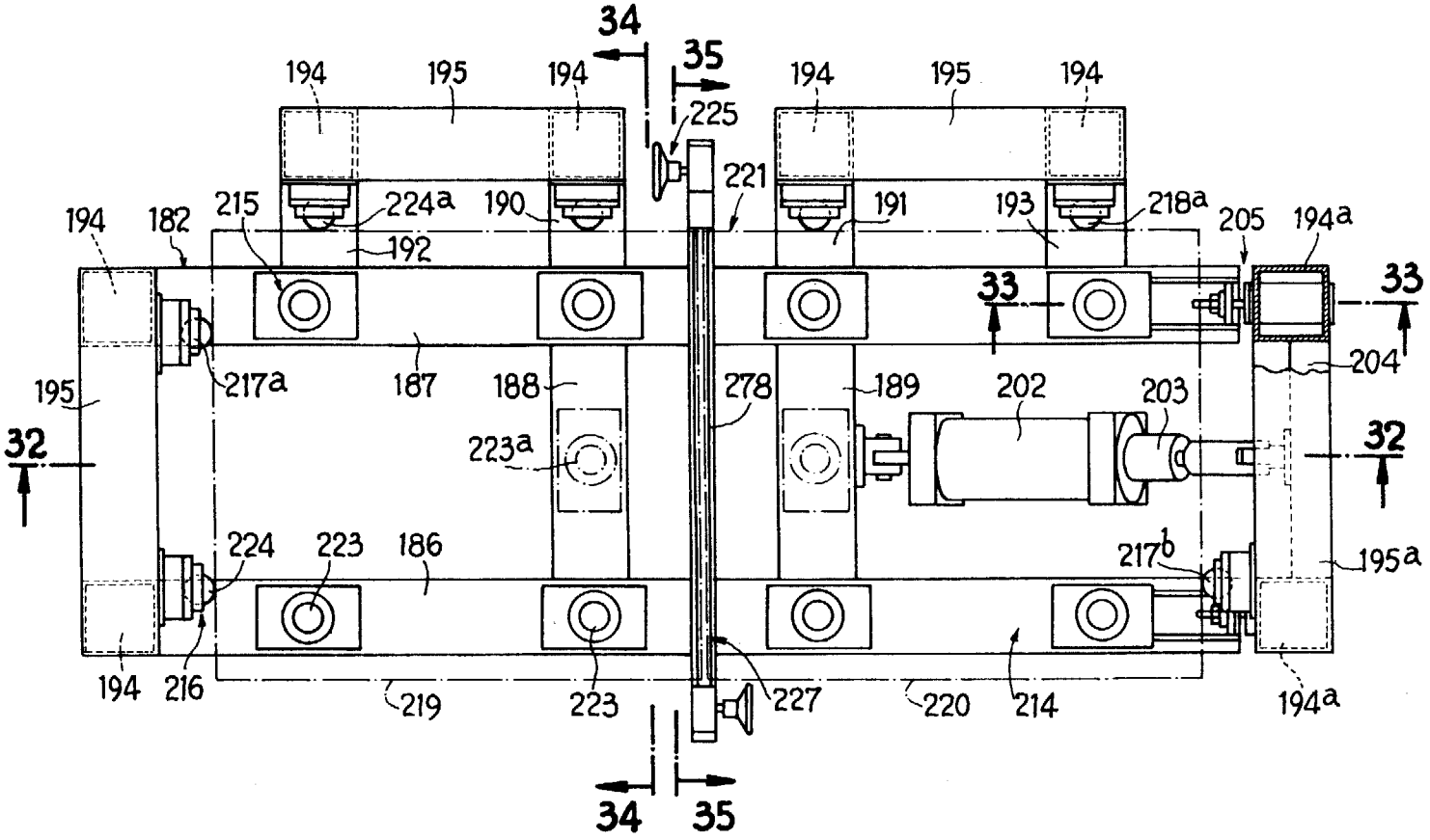
Figure 32:
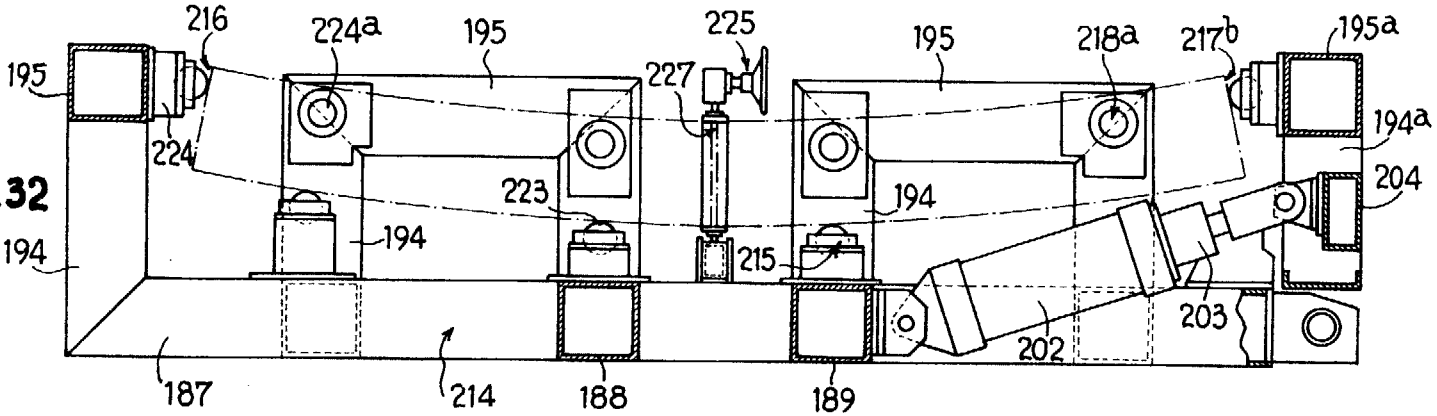
Figure 33:
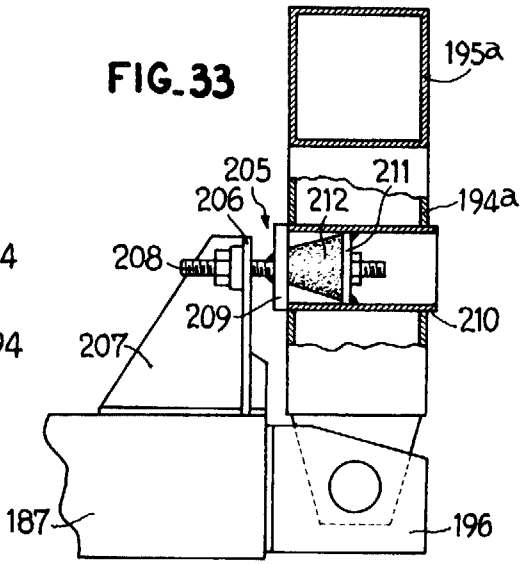
Figure 34:
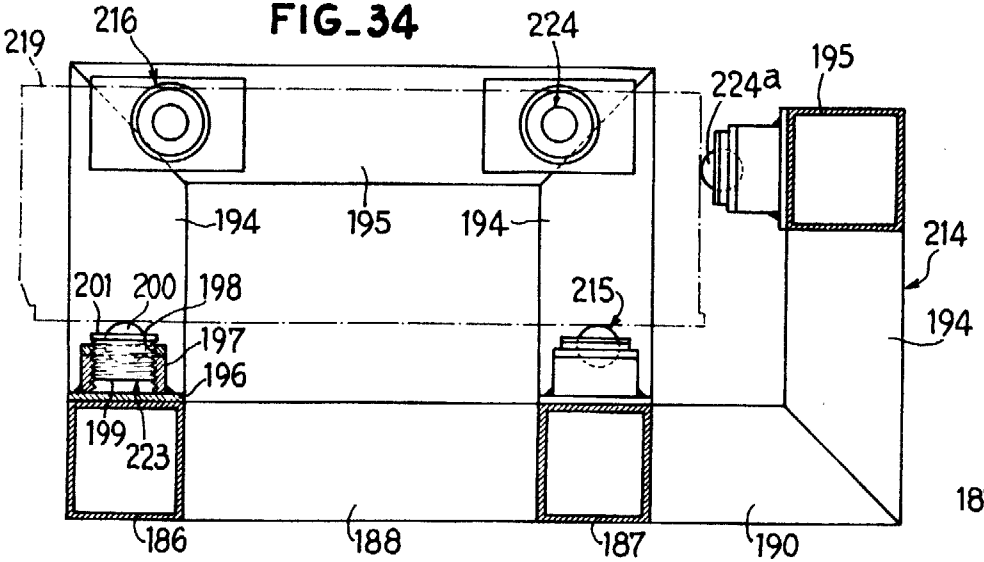
Figure 36:
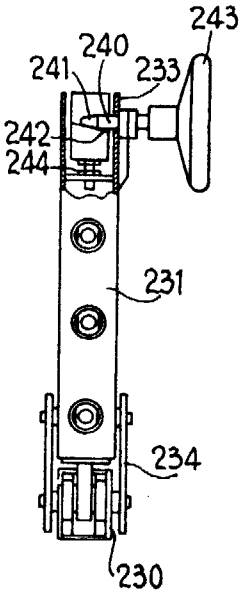
Figure 35:
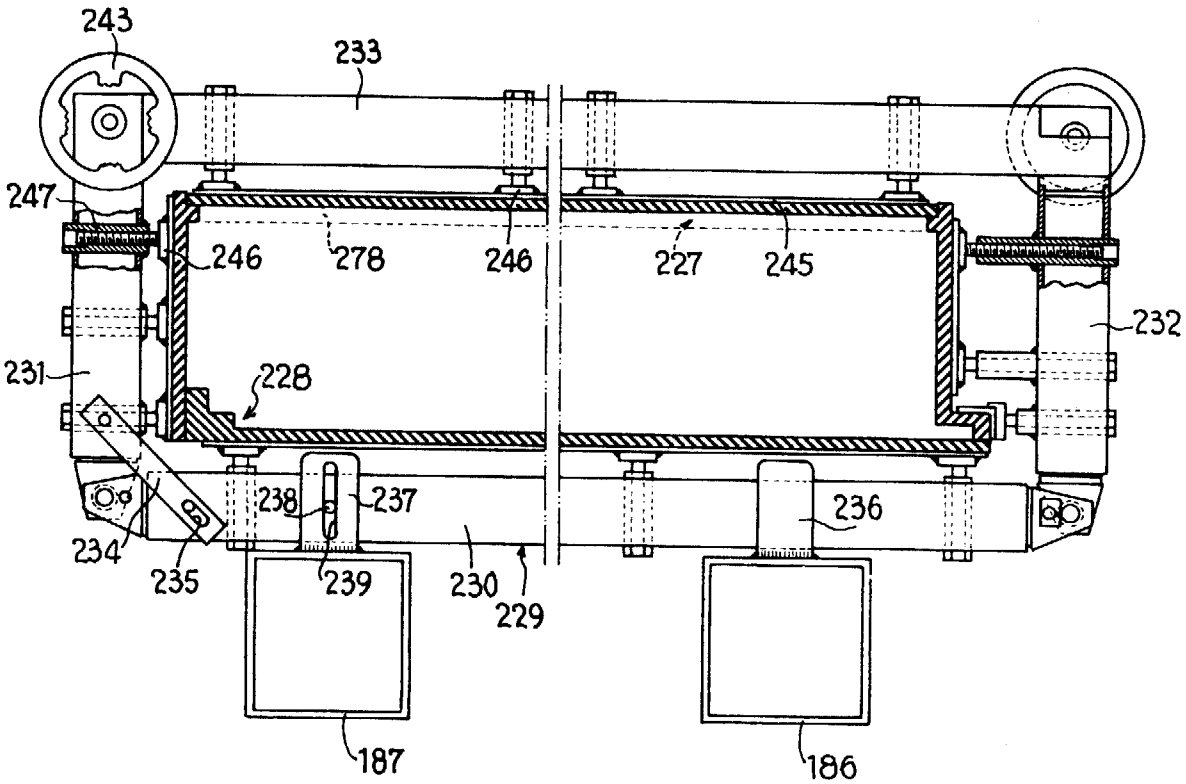

FIGS. 11 and 12 are partial perspective views of the voussoir shown in FIG. 10 in section on lines 11—11 and 12—12 of FIG. 10 respectively, these sections showing also partially the neighbouring voussoir which is applied by its adjacent face against the considered voussoir;

FIG. 13 is a diagrammatic perspective partly-exploded view of a jig according to a first embodiment of the invention for pre-assembling panels each having eight voussoirs;

FIG. 14 is a top plan view of this jig partly in section and with the cover removed;

FIG. 15 is a front elevational view of the jig shown in FIG. 14, the cover-supporting pillars having been removed;

FIG. 16 is a left view of the jig shown in FIG. 14 and consequently a right view with respect to FIG. 15, the cover-supporting pillars having been removed;

FIGS. 17 and 18 are sectional views of the jig taken on lines 17—17 and 18—18 of FIG. 15;

FIGS. 19 and 20 are respectively a rear elevational view and a left elevational view of the jig shown in FIG. 14 similar to FIGS. 15 and 16 but showing solely the base of the frame and the cover-supporting pillars;

FIGS. 21 and 22 are respectively a front elevational view and a top plan view of the cover of the jig;

FIG. 23 is a sectional view of a ball support or bearing for the jig;

FIG. 24 is a sectional view of lower sealing means for the jig;

FIGS. 25 and 26 are respectively top and cross-sectional views of a section of lining for curved parts of a tunnel, which section is constituted by four panels, each panel having four voussoirs;

FIG. 27 is a diagrammatic view of the assembly of the inner panel of this section;

FIG. 28 is a similar view of the outer section;

FIGS. 29 and 30 are respectively diagrammatic front elevational view and left elevational view of a jig according to a second embodiment of the invention of the type which is mounted inclined on a stand and permits the construction of panels having two voussoirs;

FIG. 31 is a top view of this jig independently of its stand;

FIGS. 32 and 33 are front elevational views of the jig shown in FIG. 31, FIG. 32 being a partial view, taken respectively on lines 32—32 and 33—33 of FIG. 31;

FIGS. 34 and 35 are respectively right and left views of the jig taken respectively on lines 34—34 and 35—35 of FIG. 31, and FIG. 36 is a sectional view of the sealing frame of FIG. 35 taken on line 36—36 of FIG. 35.

Figure 1:
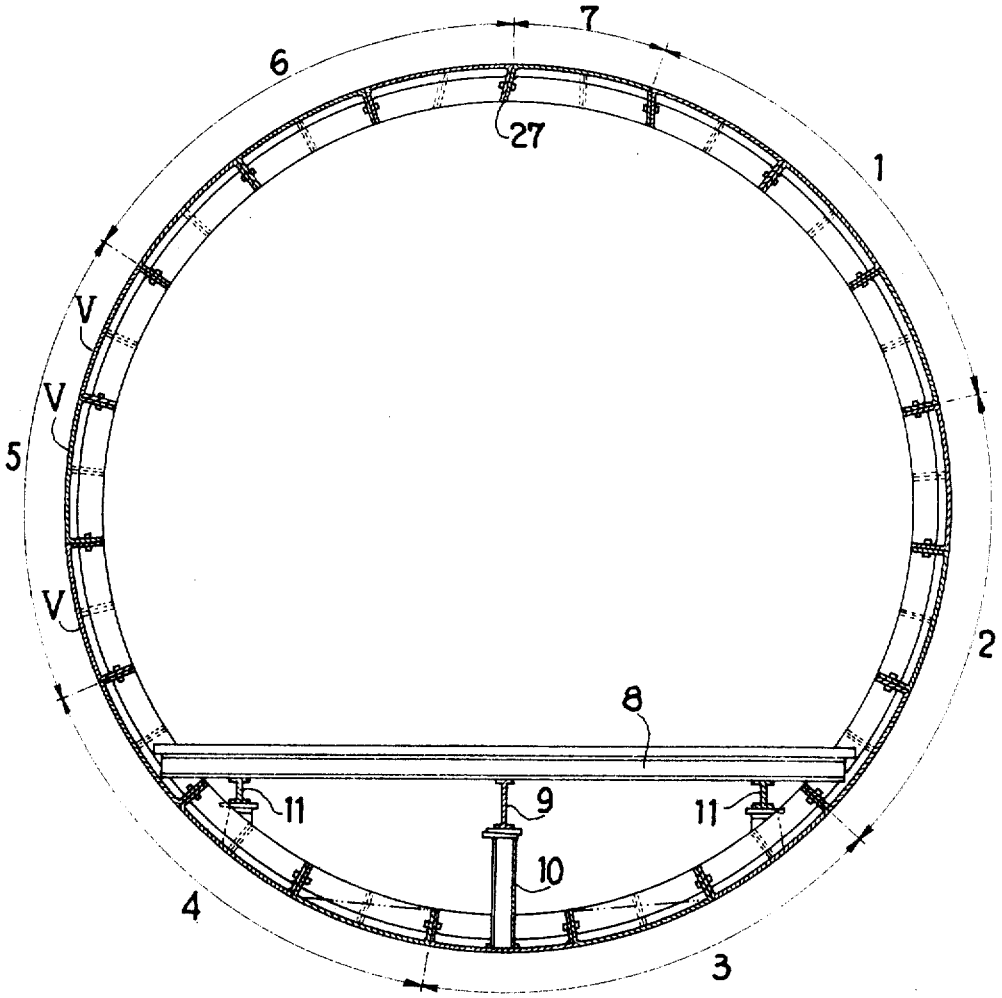
FIG. 1 is a cross-sectional view of a tunnel lining constructed in accordance with the invention.
Figure 2:
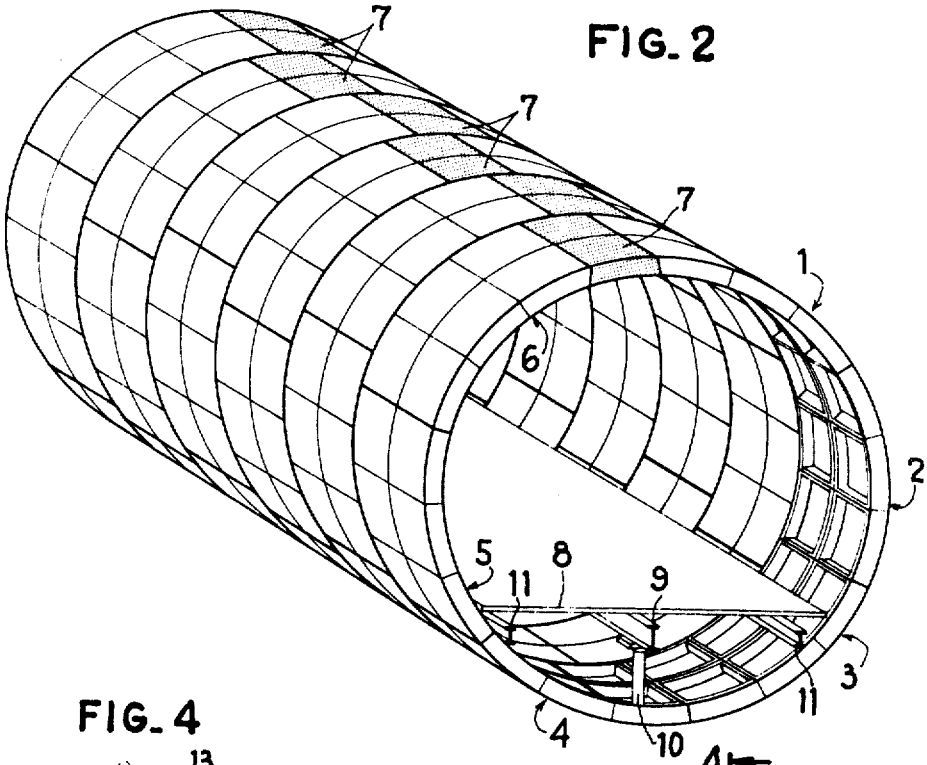
FIG. 2 is a diagrammatic perspective view of this lining.

The lining shown in FIGS. 1 and 2 is cylindrical, has a circular cross-sectional shape and comprises ring structures which are juxtaposed in the axial direction and are constituted circumferentially by six panels P or 1-6 each of which panels comprises six juxtaposed voussoirs V, that is, three in the circumferential direction and two in the axial direction. Each ring structure further comprises a centre voussoir 7 consisting solely of two voussoirs which are juxtaposed in only the axial direction. The lining further comprises a floor which is supported, on one hand, by a centre girder 9 bearing on a row of pillars 10 and, on the other hand, by two lateral girders 11.

As shown in FIG. 2, the ring structures are offset in the circumferential direction to the extent of half a voussoir alternately to the right and to the left so that the centre voussoirs roughly follow a broken line.

Each voussoir V comprises a web 12 in the form of a portion of a cylinder which is surrounded by a rectangular frame having walls 13 which are perpendicular to this web. The web has a roughly square shape and a side dimension of, for example, about 0.75 metre.

Figure 5:
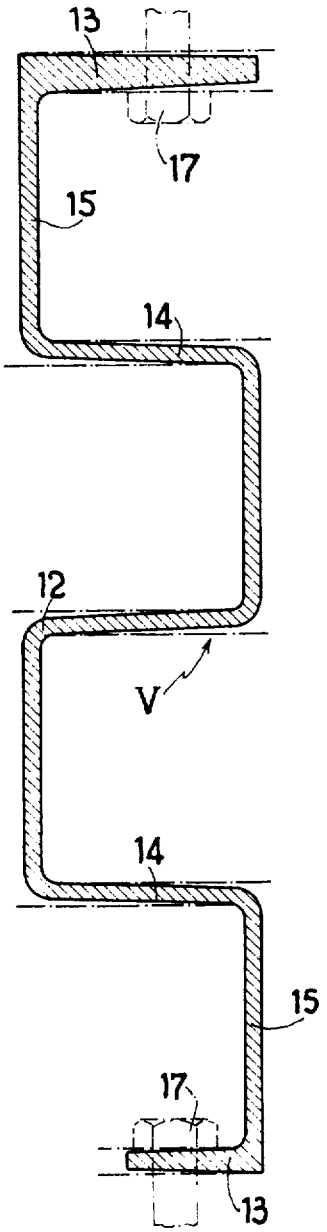
FIG. 5 is a sectional view, taken on line 5—5 of FIG. 3 of one of the voussoirs of the panel.

As shown in FIG. 5, the web has a section which is corrugated in the axial direction, the corrugations being roughly square, that is to say, comprising wall portions 14 (which are roughly parallel but in fact have a slight slope to facilitate stripping from the mould) interconnecting end wall portions 15 which are disposed alternately along two parallel lines, the end two wall portions 15 being connected to the two walls 13 of the frame which are parallel to the direction of the corrugations, one of these two walls 13 being, however, shorter than the remainder of the frame. The voussoir shown in FIG. 5 comprises between the two walls 13 three wall portions 14 and four wall portions 15. This square shape of the profile with rounded corners imparts an excellent modulus of resistance to the voussoir.

To assemble the voussoirs of the same panel, the walls 13 of the frame of the neighbouring voussoirs are brought together in the circumferential and axial directions and interconnected by means of an adhesive 16, for example an epoxyde resin base adhesive. The adhesion is completed by a bolting together, by means of bolts 17, of the walls 13 of the neighbouring voussoirs which slightly compresses the layer of adhesive and thus affords an improved resistance to forces which are other than shear forces and are liable to damage the adhesive in lining use.

Figure 6:
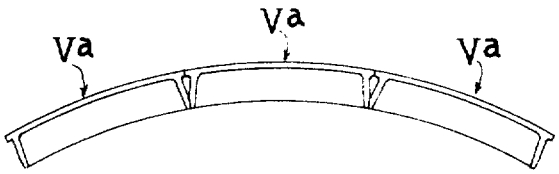
FIG. 6 is a view similar to FIG. 4, but wholly in section, of a modification of the voussoir according to the invention adapted to be pre-assembled by welding.
Figure 7:
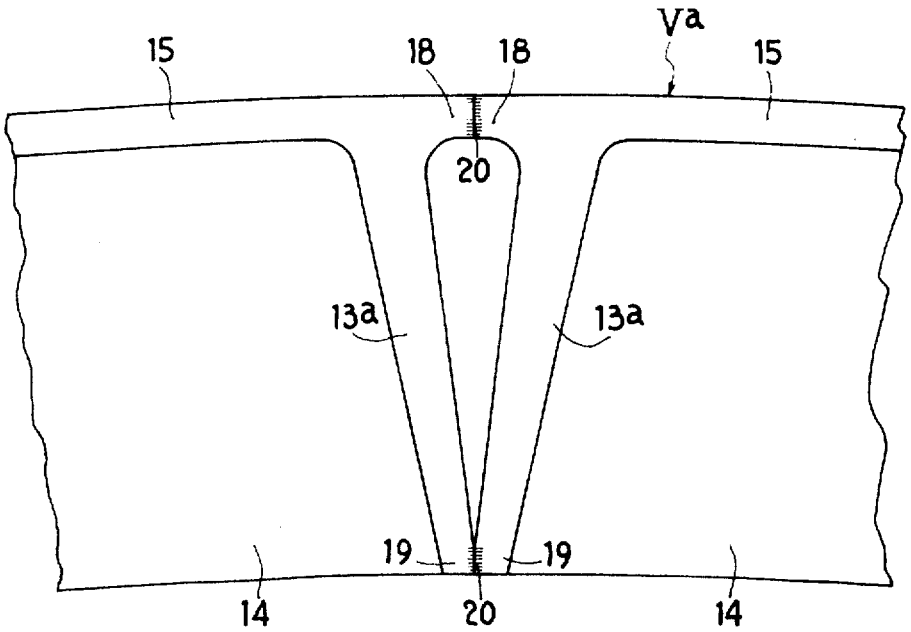
FIG. 7 is an enlarged elevational view of an assembly region of two voussoirs of such a panel.

The voussoirs $V^a$ of the modification shown in FIGS. 6 and 7 comprises a web 12 similar to that of the voussoirs V but the walls $13^a$ of their adjacent frames are slightly convergent toward the interior of the lining and extend for thus purpose, from a position slightly set back with respect to the outer contour of the frame, from the outer end wall portion 15 and define ledges 18 which extend to the outer contour of the voussoir. The neighbouring voussoirs are assembled by the ledges 18 and by the free edges 19 of the adjacent walls $13^a$ by means of a plasma welding producing weld beads 20.

The use of this type of assembly results in a very considerable saving, the weld being formed, without costly filler metal, on parts which are merely brought into edge-to-edge relation. Moreover, the structure of the weld can, provided it is annealed at 950° C, be substantially the same as that of the basic cast iron and the mechanical properties are excellent.

Figure 8:
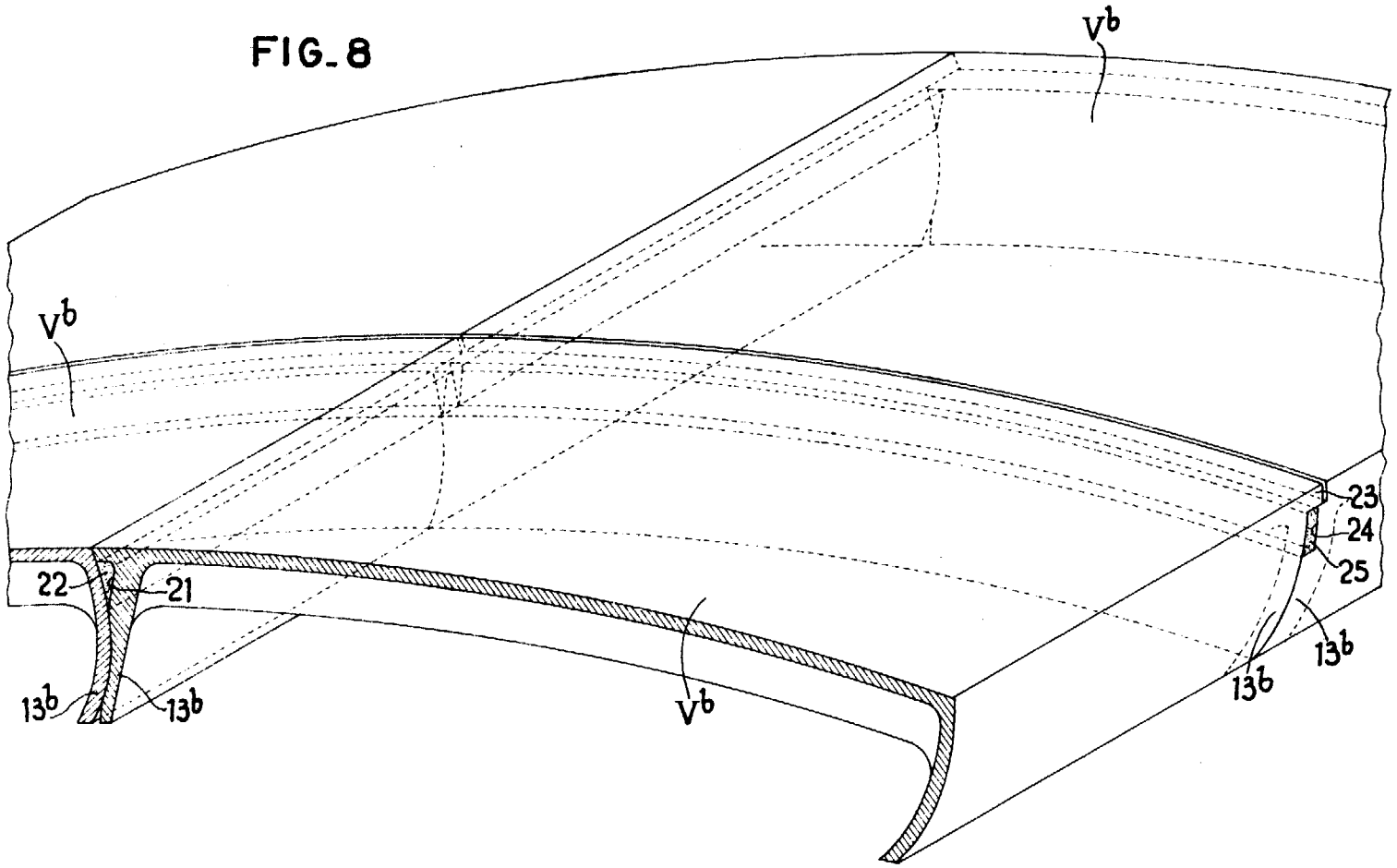
FIG. 8 is a perspective view, partly in section, of another modification of a voussoir adapted to be assembled by means of a swivel joint.

The voussoirs $V^b$ of the modification shown in FIG. 8 have frame walls $13^b$ which have slightly curved profiles, one being concave and the other convex. In the case of the axial walls $13^b$ the concave wall has in proximity to the outer surface of the lining and at a distance from this surface which is roughly equal to the thickness of the web, a longitudinal L-sectioned groove or recess 21 which acts as a cavity for receiving an adhesive joint 22 which is injected at the monent of assembly. In the case of the transverse walls $13^b$, the convex wall has a flange 23 which is flush with the outer surface and the concave wall has two stepped shoulders located adjacent the outer surface, one shoulder being adapted to receive the flange 23 of the neighbouring voussoir whereas the other shoulder defines a cavity 24 having a rectangular cross-sectional shape for receiving a joint material 25 which is also injected upon assembly.

Figure 4:
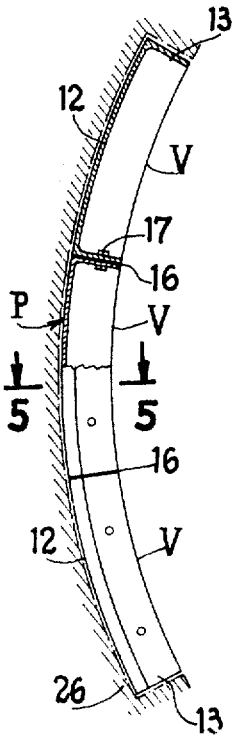
FIG. 4 is a right hand view of the panel shown in FIG. 3, half of which panel is in section on line 4—4 of FIG. 3.
Figure 3:
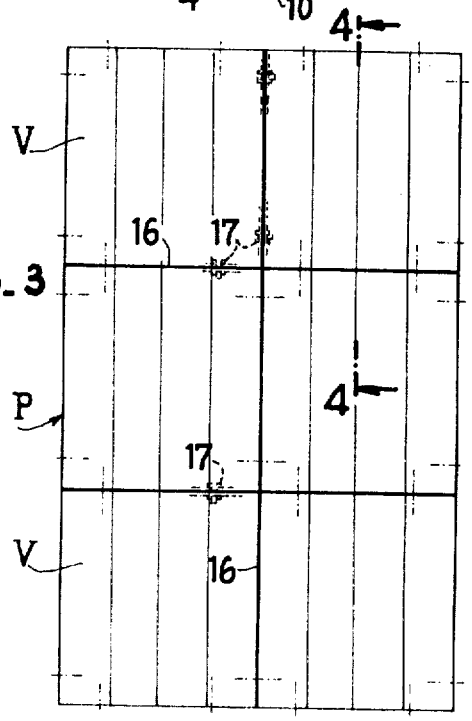
FIG. 3 is a plan view of a lining panel which has been pre-assembled in accordance with the invention by adhesion.

This swivel or ball-and-socket assembly has the following advantages: it permits an automatic, correct centering of the walls to be interconnected; it thereafter renders the correct dimensioning of the panels independent of the foundry tolerances, the positioning on a jig in the factory being indeed independent of these tolerances and the thickness of the adhesive joints injected in the grooves and cavities compensating for the dimensional differences of the moulded parts; it also permits a rapid assembly of the panels on the construction site at the very rate of boring, the curved walls $13^b$ centering themselves with no special precautions required. This adhered assembly, in the same way as that shown in FIGS. 3 and 4, is completed by a bolting which slightly pre-stresses the adhesive.

Each described arrangement, which is valid for the assembly in the factory of the voussoirs constituting a panel, applies to the assembly of the panels on the construction site as the construction of the lining of the tunnel progresses. In the factory, in respect of all the embodiments described hereinbefore, the voussoirs intended to constitute a panel are placed on an assembly jig such as that shown at 26 in FIG. 4 which defines the desired outside dimensions of the panel, then the adhesive is injected so as to form the joints between the voussoirs; lastly, the aforementioned bolting completes the action of the adhesive. On the construction site, the panels are placed in position immediately behind the boring machine with no special precautions and the gaps left for the injection of adhesive between the panels are filled after the injection of the concrete outside the lining.

Figure 9:
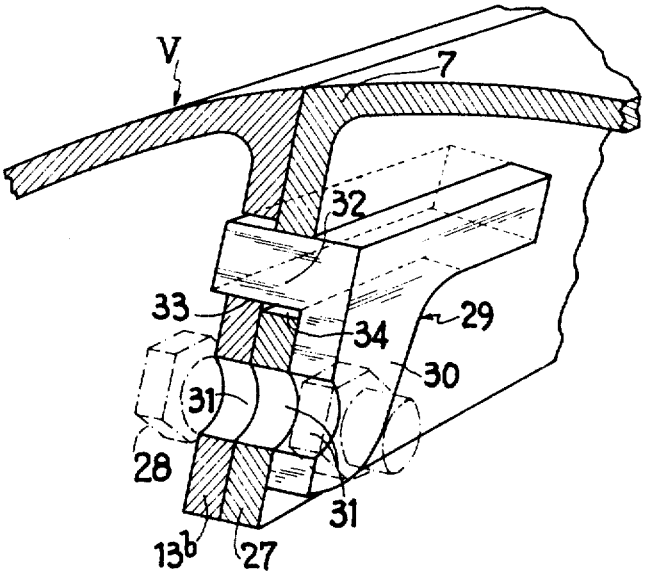
FIG. 9 is a detail view of the locking of a centre voussoir.

As shown in FIGS. 1 and 9, each centre voussoir or key-stone structure 7 has a frame whose longitudinal walls 27 no longer extend radially but diverge so as to permit positioning this centre voussoir from inside the tunnel. The adjacent walls of the neighbouring voussoirs of course have the same inclination so as to permit the support and assembly of the whole. This assembly, achieved by means of bolts 28, is locked by means of L-sectioned members 29 of which the limb 30 is applied against one of the two walls 27 or $13^b$ by means of the assembly bolt 28 which extends through holes 31 formed in the member 29 and in the two walls, whereas the other limb 32 of the L-sectioned member 29 is engaged perpendicularly to the two walls in apertures 33 and 34 which are formed in the two walls and have the size of this limb 32. These limbs 32 thus support the major part of the forces exerted by the ground and preclude a relative sliding of the walls which would otherwise inevitably shear the bolts 28. The centre voussoir 7 can thus perfectly perform its function notwithstanding the fact that the divergent shape of the walls 27 is unsuitable for this purpose.

Thus, it is possible to construct panels of large size by cheap assemblies of moulded or cast voussoirs which are mass-produced at a high production rate under excellent conditions as to cost. Further, the choice of ductile cast iron enables these large panels to be constructed with a relatively light weight compatible with excellent handling possibilities on the construction site. Thus a panel of six voussoirs may weigh less than 1 metric ton. As concerns the section of the voussoirs, the distribution of the material between a relatively thin web (end wall portions 15) and the ribs of a considerable height (wall portions 14) is particularly advantageous in the modification including the curved walls shown in FIG. 8, since it permits obtaining contacting surfaces which are large enough to afford a good connection and a reliable centering. This modification has the further advantage of lending itself to a distribution of the articulations between the panels in the course of assembly on the construction site in the regions of the periphery having a small or zero bending moment, this depending on the dimensions of the voussoirs and the number of voussoirs per panel.

The voussoir shown in FIGS. 10-12 comprises a web 1 in the shape of a portion of a cylinder surrounded by a rectangular frame constituted by walls which are perpendicular to the web and extend inwardly of the cylinder, two walls 102$^a$ and 102$^b$ being axial walls, that is to say, walls extending toward the axis X—X of the cylinder whereas the other two walls 103$^a$ and 103$^b$ are transverse walls, that is to say, walls perpendicular to said axis.

As shown in FIG. 11, the two axial walls have a slight cylindrical concavity in the radial plane, the first being concave and the second convex and having the same curvature. The wall 102$^a$ has in the vicinity of the web 101 a triangular sectioned groove 104 and, at its adjacent free end, a beveled portion 105 so as to define with the wall 102$^b$ of the adjacent voussoir applied against the wall 102$^a$ a first cavity having a triangular section 106 and a second V-sectioned cavity 107.

As shown in FIG. 12, the walls 103$^a$ and 103$^b$ are planar. The wall 103$^a$ has in its corner adjoining the web 101 a double shoulder 108–109 whereas the opposite wall 103$^b$ has along the same corner a flange adapted to engage in the second shoulder 109 which is the nearer to the web when the wall 103$^b$ of the neighbouring voussoir is brought in contact with the wall 103$^a$ of the considered voussoir. Further, the two walls 103$^a$ and 103$^b$ each have at their free end a shoulder 111$^a$ or 111$^b$. Consequently, the walls 103$^a$ and 103$^b$ of two adjacent voussoirs define therebetween, on one hand, a closed cavity 112$^a$ in the vicinity of the web 1 and, on the other hand, an open cavity 112$^b$ adjacent the free edge.

As shown in FIG. 10, the walls 102$^a$ and 103$^a$ each have on their outer surface and in the middle of their length a radial groove 113$^a$ or 113$^b$ which communicates at one end either with the axial cavity 106 or with the circumferential cavity 112 whereas at the other end it communicates directly with the interior of the voussoir. The pre-assembling jig for panels having eight voussoirs shown in FIGS. 13–25 comprises generally, as shown diagrammatically in FIG. 13, a frame 14 which has a device 115 for supporting the webs of voussoirs voussirs and has a general shape of a portion of a cylinder and a device 116 for bearing against the walls of the voussoir. This bearing device comprises two groups of bearing means 117$^a$–117$^b$ and 118$^a$–118$^b$. The first group comprises two series 117$^a$ and 117$^b$ of bearing means located in mean planes perpendicular to the cylindrical shape of the device 115 and extending radially, that is to say, passing through the axis of this shape. The second group comprises two series 118$^a$ and 118$^b$ of bearing means also contained in mean planes perpendicular to the cylindrical shape of the device 115 but perpendicular to the axis of the latter. The devices 114 and 116 together define a volume which is intended to receive an assembly of eight voussoirs, 119$^a$, 119$^b$, 119$^c$, 119$^d$, and 120$^a$, 120$^b$, 120$^c$, 120$^d$ which are juxtaposed in pairs in the axial direction and in groups of four in the circumferential direction so as to constitute a panel 121 having the general shape of a portion of a cylinder and a substantially rectangular contour. The mean planes of the two series of bearing means of the same group 117$^a$, 117$^b$, 118$^a$, 118$^b$ are located at a predetermined distance from each other in respect of each group, the distances corresponding to the dimensions required for the panels to be pre-assembled on the jig. The latter is completed by a cover of convex shape 122 adapted to constitute an upper closure of the cavity offered to the assembly of eight voussoirs.

The support device 115 comprises a number of discontinuous support means 123, that is to say that the points of contact of the voussoirs supported by these means are separate and spaced apart. The same is true of the bearing means of the bearing device 116, that is to say, the points of contact of the voussoirs against which these means bear are also separate and spaced apart. The separate support means 123 and the separate bearing means 124 are designated diagrammatically by crosses in FIG. 13. A sealing device 125 is also provided in the form of a grill which is shown in the region of the support device 115 along the adjacent contours of the voussoirs and sealing means 126 also placed in the plane of the groups of bearing means 117$^a$, 117$^b$ and 118$^a$ and 118$^b$, in the region of the adjacent contours of the voussoirs. Another upper sealing device 127 has a shape corresponding to that of the device 125 and is adapted to be disposed between the panels 121 and the cover 122. Each one of the series 117$^a$ and 117$^b$ of axial bearing means is mounted to be pivotable with respect to the frame 114 whereas one, 118$^a$, of the series of transverse bearing means is fixed with respect to the frame and the other series, 118$^b$, is slidably mounted with respect to the frame in a direction parallel to the axis of the cylindrical shape, the cover 122 being slidably mounted with respect to the frame for sliding movement in a direction perpendicular to the cylindrical shape.

As shown in more detail in FIGS. 14, 15 and 16, the frame 114 comprises a stand 128 and a box structure 129 fixed to the stand. The stand 128 has the general shape of a planar plate or platform and comprises an assembly of I-section members or square-section members. The box structure 129 has four vertical walls, two parallel transverse walls, that is to say walls perpendicular to the axis X—X of the cylindrical shape 115, one wall being a front wall 130 and the other a rear wall 131, and two longitudinal walls, that is to say walls which are parallel to the axis X—X, 132 and 133. These vertical walls are secured to the stand 128 and the box structure is closed in its upper part by a bent sheet 134 having an axis X-X and defined by a radius slightly greater than the radius of the support device 115 and its support means 123, this sheet being if necessaary reinforced by ribs on its lower surface. This bent sheet 134 constitutes the bottom of the jig. It is on this sheet that the support means 123 are fixed, which means are provided in the number of four per voussoir and disposed at the corner of a square for each one thereof, the assembly of these means being thus arranged in four rows in one direction and in eight rows in the other direction.

As shown in FIGS. 15 and 16, although they are only represented by crosses in FIG. 14, these support means are in fact blocks carrying each one a ball and oriented radially, that is to say facing the axis X—X. As shown in FIG. 13, each ball block 123 comprises a cup-shaped portion 135 in which is disposed a conventional ball assembly 136 having a ball 137, a portion of which extends through an aperture in a closing plate 138. Integral with the bottom of the cup-shaped portion 135 is a screwthreaded stem 139 which is screwed into a tapped bore of a sleeve 140 which extends through an aperture 141 in the bent sheet 134 to which it is welded. The stem 139 is held stationary in the required position with respect to the sleeve 140 by a stop-nut 142.

As shown in FIGS. 15 and 16, each one of the longitudinal series 117$^a$ and 117$^b$ of bearing means 124 is secured to a horizontal girder 143 which is integral with the upper end of two uprights 144 which are integral at their lower end with a longitudinal horizontal shaft 145 which is journalled in bearings 146 secured to the longitudinal walls 132 and 133 of the box structure 129. Each shaft 145 carries in its middle a transverse crank arm 147 to the end of which is pivoted the rod 148 of a hydraulic cylinder device, the body of which device is pivoted to the stand 128 inside the box structure 129 to pivot about a longitudinal axis. As shown in FIG. 16, each crank arm 147 extends through an opening 150 in the longitudinal walls 142 or 143 of the box structure.

As shown in FIGS. 14 to 16, the fixed transverse series 118$^a$ of bearing means 124 is secured to a vertical sheet 151 in the form of a sector of a circular ring which is disposed above the level of the bottom sheet 134 and carried by a transverse box structure 152 which is itself secured to two longitudinal members extending beyond the stand 128. As also shown in FIGS. 14 to 16, the transverse movable series 118$^b$ of bearing means 124 is also secured to a sheet 153 identical to the sheet 151 and carried by a transverse box structure 154. This box structure is secured to two hollow horizontal and longitudinally extending cylindrical shafts 155 which are arranged symmetrically in the same horizontal plane and are each guided to slide longitudinally between two grooved wheels 156 and 157 which are journalled in the stand 128, one of the wheels being outside the box structure 129 and the other inside the latter. Pivoted to the box structure 154 and located between the hollow shafts 155 is also the rod 158 of a cylinder device whose body 159 is disposed horizontally in the longitudinal direction inside the box structure 129 and is pivoted to the stand 128.

The bearing means 124 and the series of means 117$^a$, 117$^b$, 118$^a$ and 118$^b$ are ball blocks exactly identical to the blocks 123 which are secured to the bottom sheet 134 and whose structure has been described with reference to FIG. 23, the sleeve 140 being secured to the girders 143 and to the sheets 151 and 153. The axes of the ball blocks of the series 118$^a$ and 118$^b$ are oriented to be parallel to the axis X—X and are consequently perpendicular to the outer walls of the panel 121 having eight voussoirs. Likewise, the flanges of the girders 143 to which the ball blocks 124 of the longitudinal series 117$^a$ and 117$^b$ are secured are radially oriented, that is to say, oriented in the direction of the axis X—X, so that the axes of the blocks are also perpendicular to the longitudinal faces of the panel 121. The height of the girders 143 and of the sheets 151 and 153 is such that the blocks 124 are located at a mean level of the walls of the pannel.

Whereas the sheet 151 is fixed to the stand 128 and therefore with respect to the box structure 129, the sheet 153 and the girders 143 are brought to the required positions of adjustments to obtain the predetermined dimension of the jig. This positioning is achieved, on one hand, by means of longitudinal girders 150 which are integral with the uprights 144 and bear against stops having an adjustable spherical end surface 161 which are fixed to inclined faces 162 of the longitudinal walls 132 and 133 of the box structure, these inclined faces being oriented radially in the direction of the axis X—X, and, on the other hand, by means of a transverse member 163 which is fixed below the box structure 154 and also carries stops having an adjustable spherical bearing surface 164 which bear against a transverse vertical flange 165 of the stand 128.

There are eight ball blocks 124 on each one of the sheets 151 and 153 on which they are disposed on the same arc of a circle, there being four thereof on each one of the girders 143 on which they are disposed along a longitudinal straight line. In this way, there are two bearing ball blocks 124 facing each one of the outer surfaces of the voussoirs constituting the panels 121.

As shown in FIGS. 19 to 22, the cover 122 is constituted by a chassis 166 having a rectangular contour and four corners with which vertical downwardly extending pillars 167 are integral. The chassis 166 has a lower surface in the shape of a portion of a cylinder corresponding substantially to the contour of the panel 121 and this chassis is apertured so as to define along this lower surface longitudinal portions and transverse portions adapted to overlap (by distinctly extending therebeyond) the square pattern constituted by the juxtaposed walls and the exterior walls of the voussoirs constituting the panel 121. The pillars 167 define at their lower end cylindrical recesses 169 adapted to be fitted on vertical cylindrical end members 170 disposed above vertical pillars 171 located at the four corners of the stand 128. The height of the pillars 171 and of the columns 157 is such that, when the cover is resting on the frame, the lower sheet 168 of the cover comes in contact with the panel 121 placed on the supporting ball blocks 123 with interposition of the sealing device 127 which will be described hereinafter. The locking of the covers in this position is achieved by means of keys 172 which are engaged in horizontal apertures formed both in recessed portions of the columns 167 and in the end members 170. Hooks 173 secured to the upper part of the chassis 166 permit the handling of the cover by means of a travelling crane.

The lower sealing device 126 comprises supports 174 which are consituted by inverted U-section members fixed to the upper face of the bent sheet 134 in accordance with a grill arrangement located below the gaps between the voussoirs of the panel 121. Fixed to the upper face of each one of the section members 174 and throughout its length is an inflatable rubber sealing means 175 whose edges are fixed to the member by L-section members, this inflatable sealing means being itself covered with a planar rubber sealing means 176 as shown in FIG. 24. The level of the free surface of these means 176 substantially corresponds to that of the balls of the support means 123.

As shown in FIGS. 15 and 17, the peripheral sealing means 176 are constituted by a number of tabs 177 which are fixed to the sheets 151 and 153 and to the girders 143 in the region of the radial gaps between the voussoirs. Thus, these means are in the number of three on each one of the sheets 151 and 153, there being a single shoe in the middle of each girder 143. These shoes have rubber elements which match the profile of the voussoirs.

As concerns the upper sealing device 127, which has a shape identical to the shape of the assembly of the sealing means of the lower device 125, it is constituted by an assembly of elastomer beadings 178 whose section is generally T-shaped, the leg of which is slightly convergent towards its free end.

The jig just described is employed in the following manner:

In the initial position, the cover 122 is raised and the cylinder devices 149 and 159 are placed in their extended position so that all the bearing means 124 are withdrawn. The various voussoirs are then brought above the support means 123 and they are juxtaposed in such manner that their walls are roughly in contact with each other. The only adjustment effected on the ball blocks which constitute the support means 123 consists in bringing them to a level in which they define together a cylindrical surface which must match the outer surfaces of the webs of the voussoirs, this adjustment thus serving solely to arrange that the voussoirs assume their position in accordance with the required general shape and in juxtaposition with each other.

Thereafter, the transverse movable series 118$^b$ of bearing means is brought to a certain standby distance from the frame by partially retracting the cylinder devices 159. Thereafter, the two longitudinal series 117$^a$ and 117$^b$ of bearing means are brought to the final position by totally retracting the cylinder devices 149 which in this way embody the final required circumferential dimension for the panel. This is achieved by the fact that the transverse members 160 come into abutment with the stops 161 and this is accompanied by a compression of the sealing means carried by the shoes 177 which ensures the sealing along the radial gaps between the voussoirs. The cylinder device 159 is then fully withdrawn so that the bearing means 124 of the movable series 118$^b$ assume their final position which thus defines the desired predetermined longitudinal dimension of the jig. This positioning is accompanied by a compression of the shoes 177 carried by the sheets 151 and 153 and this ensures the sealing of the radial gaps between the voussoirs on the transverse faces of the panel. All of the beadings 178 are then deposited in such manner that the vertical limbs of their section penetrate the respective gaps 117 and 112$^b$ between the walls of the voussoirs at their upwardly-facing end. The cover 122 is then lowered and bears against the beadings 178 and causes the latter to penetrate the aforementioned cavities and this has for effect to shift apart the juxtaposed walls of the voussoirs by successively urging the latter with respect to each other from the middle of the jig until the voussoirs bear against the means 124. The shape and the quality of the elastomer constituting the beadings 178 enable them to exert a reaction between the walls of the voussoirs which are thus urged against the bearing means, even in opposition to the thrust due to the weight of the voussoirs which has a tendency to urge them in the circumferential direction toward the centre of the jig. The sealing means 175 are then inflated so as to seal the gaps between the webs of the voussoirs.

The obbtainment of the exact desired dimensions and the sealing having thus been ensured, a connecting material is injected into the gaps between the juxtaposed faces of the voussoirs. In a first embodiment, a liquid adhesive material is injected by using a single one of the radial grooves 113$^a$, the other radial grooves being closed. The material flows from this radial groove into the longitudinal and transverse cavities 106 and 112$^a$ then rises from these cavities between the walls of the voussoirs, the material being consequently propagated little by little along the network of grooves so as to finally fill all the gaps between the juxtaposed walls of the voussoirs defined by the sealing means described hereinbefore.

The adhesive material is then hardened by stoving with the aid of hot air or steam which enters by way of openings formed in the sheets 151 and 163 below the bearing means 124 and reaches the interior of the volume defined between the bottom sheet 134, the various bearing assemblies and the lower face of the panel. The flow of hot air or steam is still further promoted by the presence of openings formed in the roughly vertical flanges of the location members 174 supporting the inflatable sealing means 175. Thus, subsequent to the maturing and hardening of the adhesive material, the assembled panel can be extracted by opening the jig in a procedure which is the reverse of that described for positioning the panel.

In another embodiment, an adhesive cement, mastic or putty is employed as connecting material which is in the form of bands which are adhhered in the grooves 106 and 108 of the voussoirs before they are placed in position. The closure of the jig then compresses these bands of adhesive cement or putty and causes the latter to flow through the gaps between the walls of the voussoirs and it is then merely necessary to scrape off the excess cement or putty and the panel is now in its assembled condition.

In a third embodiment, there is employed a compressible connecting or bonding material having physical characteristics, and in particular a specific volume, capable of absorbing by compression or expansion the longitudinal dimensional variations in the voussoirs under the effect of thermal phenomena to which the final lining constituted by the pre-assembled panels may be subjected. These phenomena are usually expansions due to the effect of heat. In the assembly of the lining constituted by the juxtaposition of ring structures, each of which is constituted by a juxtaposition of pre-assembled panels, there may be provided, for example every twenty or thirty ring strucutres, special panels whose connecting material would be of this type. It will be understood that, in order to simplify work, all the joints of this panel, whether they be transverse or longitudinal joints, would be of this same connecting material. The physical characteristics of this material must of course guarantee upon pre-assembly dimensions identical to those necessary for a good assembly on the construction site.

The jig whose structure and operation have just been described has the following advantages, among others:

The application of the voussoirs against the longitudinal and transverse bearing means 124, before the final assembly of the panel has been achieved by means of the connecting material, enables the dimensional variations that the voussoirs may posses with respect to the theoretical dimensions to be compensated for, which is essential in the case of moulded or cast voussoirs, for example cast iron voussoirs. The precision of the positioning of the bearing means 124 is very important since it is this precision which defines the precise dimensions of the pre-assembled panel. The reference surface defined by the bearing means which may be, for example, compared to a belt, enables the outer walls of the voussoirs to be placed in the exact positions so that the resulting panel has the desired dimensions, this positioning being achieved by means of spreading means constituted by the beadings 178. Only the whole of the bearing means 124 may be termed a reference surface since the cylindrical surface embodied by the support means 123 performs only a supporting function.

A jig in which the support surface and the bearing surfaces are defined only in a discontinuous manner by an assembly of separate and spaced-apart points of contact embodied by the balls of the blocks 123 and 124 is much more convenient to use than a jig whose surfaces would be embodied by continuous and solid faces. In this way, metal working difficulties are avoided. Secondly, parasitic bending forces are avoided, the jig of the voussoirs being capable of undergoing a certain distorsion. The handling of the voussoirs on separate points of contact is much easier.

To this very general interest of the adjustable character of the support and bearing means, there could be added the following interesting advantage: this adjustment of the bearing means 124 enables panels of non-rectangular shape to be prepared which are intended to be employed in sections of a lining for a tunnel corresponding to changes in direction or bends. Such a section is represented in FIGS. 25 and 26 which show this section as being constituted by the juxtaposition of six panels each of which is constituted by four voussoirs. The upper and lower panels 179 have a trapezoidal shape as seen in FIG. 25. On the other hand, the panel 180 on the inside of the bend has a shape which is constricted in its middle part as shown diagrammatically in FIG. 27, whereas the panel 181 located on the outside of the bend has, on the contrary, a enlarged barrel shape such as shown in FIG. 28. Thus, for the pre-assembly of the panel 180, it is sufficient to put the transverse centre ball blocks and the longitudinal end ball blocks under maximum extension and the transverse end ball blocks and the longitudinal centre ball blocks under a minimum extension. This configuration enables, when the four voussoirs constituting the panel are urged against the thus adjusted ball blocks, a wedge-shaped space to be formed between the voussoirs of the same longitudinal pair and a very flattened diamond shaped space to be formed between the assembly of four voussoirs, all of these spaces being filled with the connecting material in a subsequent step of the procedure so as to give to the final pre-assembled panels the suitable constricted shape. A similar arrangement would be adopted for an enlarged panel 181. It will be clear that other configurations of lining sections may be chosen but in every case the structure of the jig permits an adpation to the desired panel shape. However, it shoud be mentioned that the adjustable arrangement of the bearing means is justified even without considering this problem of a change in direction of a lining.

The final assembly of the panel lining by the assembly of pre-assembled panels is accompanied by the provision of joints between these panels. Now, it might occur that, after the assembly and during the life of the lining, it is necessary to carry out an additional sealing. Although the sealing quality of the initial joints produced in the factory between the voussoirs of a given panel is in itself more reliable than tnat of the initial joints between the panels, this additional sealing may be carried out both in the region of the factory joints between the pre-assembled voussoirs and in the region of the joints made between the panels on the site. This additional sealing is then carried out in the longitudinal cavities 108 and circumferential cavities 112$^b$ which remain open at the end of the walls of the voussoirs which face the interior of the lining. For this purpose, these cavities may receive joints of various types for example adhesive joints placed in position in the liquid state, adhesive cement, mastic or putty or compressible joints.

Having recalled that the network of joints which constitutes the spreading device 127, which serves not only to spread apart the voussoirs but also to limit the network of cavities presented for the injection of the connecting material, is independent of the cover 122 and is merely held in position by the latter, the advantage afforded by these joints should be mentioned as concerns possible sliding of the voussoirs. It indeed occurs that the latter tend to slide or slip under the effect of the application of the shoes 177 which constitute the peripheral sealing device 126. Now, this sealing cannot exist without a sufficient force of application, but it is essential that this force avoid shifting the voussoirs out of contact with the ball blocks 124, constituting the bearing means, which would be liable to shift the voussoirs toward the centre. It is here that the spreading joints 178 of the device 127 intervene to preclude the sliding of the voussoirs. It will be observed that the order of closure of the various elements of the jig indicated hereinbefore is essential to ensure that these joints be capable of performing this anti-sliding function.

It must finally be mentioned that the mobile quality of three of the bearing means series, namely the series 117$^a$, 117$^b$, 118$^b$ possessed by the jig shown in FIGS. 10 to 24 is particularly advantageous. It will indeed be understood that, on principle, it is sufficient that two of the four series be withdrawable, these series being adjacent whereas the other two series would be fixed. In practice, in the case of the described panel having eight voussoirs, there are difficulties of handling these considerable masses so that it is preferred to provide a third series of withdrawable bearing means. The permits in practice an extraction of the panel with no need to slide the latter on the support surface constituted by the ball blocks 123. It will be observed, on the other hand, that this necessity is less important in the case which will be described hereinafter of panels which have only two voussoirs and are therefore less difficult to move.

The jig shown diagrammatically in FIGS. 29 and 30 and in more detail in FIGS. 31 to 36 and intended for the pre-assembly of a panel 221 from two voussoirs 219 and 220 which are juxtaposed in the circumferential direction by two longitudinal faces, generally comprises a frame 240 provided with a device 215 for supporting the webs of the voussoirs and having the general shape of a portion of a cylinder, a device 216 for bearing against the free longitudinal walls of the voussoirs, a series of aligning means 218$^a$ for the transverse faces of the voussiors, a device 225 for sealing the joint between the longitudinal faces of the voussoirs and a device 227 for spreading apart these walls. The bearing device 216 is constituted by two series of bearing means 217$^a$ and 217$^b$.

The frame 214 comprises a chassis 182 and a supporting tripod 183 which includes a hollow vertical column 184 which is truncated at its upper end in a plane which is inclined to the horizontal, this end receiving a plate 185 on which the chassis 182 is supported and fixed. The chasis comprises an assembly of hollow square-section members having two parallel longitudinal members 186 and 187 of the same length and two parallel transverse members 188 and 189 which interconnect the two longitudinal members on each side of their middle parts and in the vicinity of the latter. Fixed to the member 187 and extending horizontally outwardly are four transverse members of the same length, two of which, 190 and 191, are in the extension of the transverse members 188 and 189 whereas the other two, 192 and 193, are located in the vicinity of the ends of the longitudinal member 187. Six vertical uprights 194 are fixed to one of the free ends of the two members 186 and 187 and to the free ends of the four members 190 to 193, the upper ends of these uprights being interconnected in pairs by girders 195. The longitudinal members 186 and 187 carry at their other free end horizontal extensions 196 on which are mounted, to pivot about an axis parallel to the transverse members 188 and 189, the lower ends of two uprights 194$^a$ which are interconnected at their upper end by a horizontal girder 195$^a$.

It must be understood that the terms horizontal and vertical just employed relate to the general orientation of the chassis 182. In actual fact, the inclination of the plate 185 and the orientation in which the chassis 182 is fixed to this plate are such that the longitudinal members 186 and 187, on one hand, and the transverse members 188 and 189, on the other, make angles of the order of a few degrees, for example 7° to a horizontal plane, the longitudinal members 186 and 187 rising toward the side corresponding to the pivotable connection of the uprights 194$^a$ whereas the transverse members 188 and 189 descend in the direction of the members 190 and 191.

As in the first embodiment, the support device 215 comprises a number of discontinuous support means 223 and the series 217$^a$ and 217$^b$ of bearing means and the series 218$^a$ of aligning means are also constituted by a number of bearing means 224 and aligning means 224$^a$. These support means 223, bearing means 224 and aligning means 224$^a$ are also constituted by ball blocks but which blocks have a slightly different structure. There are eight blocks evenly spaced apart in an arrangement of four on each one of the longitudinal members 186 and 187 for the support means, four blocks arranged in pairs on each one of the girders 195 and 195$^a$ for the bearing means, and four blocks arranged in pairs on each one of the girders 195 for the aligning means. All these blocks are fixed to the longitudinal members and the girders in such manner that some have their axes perpendicular to the webs of the voussoirs and some have their axes perpendicular to the walls of the voussoirs. As shown in particular in FIG. 33, each one of the ball blocks constituting the support means, bearing means or aligning means comprises a base plate 196 to which is welded a tube 197 having an internal screwthread and in which is screwed a second screthreaded tube 198 which is provided with a transverse partition wall 199 on which bears a ball 200 retained by a cover 201 provided with an opening.

Thus, there are associated with each voussoir, four support means 223, two of which means are moreover disposed in the region of the transverse member 188 or 189, two bearing means 224 and two aligning means 224$^a$. However, this number and this arrangement of the ball blocks correspond to the case of voussoirs having a web in the form of a pure cylinder. On the other hand, in the case of voussoirs having a corrugated web which has, for example, three corrugation roots, the two ball blocks disposed in the region of the transverse member 188 or 189 are replaced by a single intermediate ball block 223$^a$ disposed in the middle of this transverse member, each one of the blocks then supporting one of the corrugation roots.

The lateral frame constituted by the uprights 195$^a$ and the girder 194$^a$ may be moved about its axis by means of a cylinder device whose body 202 is pivoted to the transverse member 189 and is perpendicular to the latter whereas its rod 203 is pivoted to an intermediate transverse member 204 of smaller section fixed between the two uprights 195$^a$. Further, the raising of the frame achieved by means of this cylinder device is limited by two adjustable stops 205 disposed in the region of the longitudinal members 186 and 187 and the uprights 194$^a$. As shown in more detail in FIG. 34, a vertical plate 206 is fixed to the longitudinal member 186 or 187 perpendicular to the longitudinal direction of the latter and slightly set back with respect to its end, this plate being supported by a gusset 207. It carries in its upper part a screwthreaded rod 208 whose outer end is welded to a stop plate 209. Each upright 194$^a$ has extending therethrough a horizontal sleeve 210 to which is fixed a damping or shock-absorbing element 212, for example of rubber such as that known under the trade name of "Paulstra", this damping element extending beyond the end of the sleeve 210 so as to bear against, and be crushed by, the stop plate 209.

The sealing device 225 comprises a sealing means 228 and a pressure-applying frame 229. The means 228 is an elastically yieldable means and constituted by one or more elements matching the contour of the voussoirs in the longitudinal direction of the lining to be produced. The pressure-applying frame 229 has a generally rectangular shape and comprises four square-section members: a lower horizontal section member 230, two vertical section members 231 and 232, and an upper horizontal section member 233. The two members 231 and 232 are pivotably mounted at each of the ends of the lower member 230, the pivoting of the member 231 which is located adjacent the longitudinal member 187, and consequently the aligning means 234$^a$, being limited by the set of two flat bars 234 which are obliquely oriented and pivoted at one end to the member 231, whereas at their other end they have elongated apertures 234 which are slidable on lateral pins or studs carried by the member 230. This horizontal lower member 230 is disposed above, and is perpendicular to, the members 186 and 187 and is slidably guided in the vertical direction between two pairs of vertical tabs 236 and 237 fixed above the longitudinal members, it being solely maintained by lateral studs 238 which slide in vertical elongated apertures 239 in the tabs 237, there being no connection in the region of the tabs 236.

The upper horizontal member 233 bears at its ends between U-shaped extensions of the vertical section members 231 and 232 and it is maintained integral with the latter by screwthreaded rods 240 which are screwed in these extensions and whose conical inner end 241 bears against inclined shoulders 242 formed at the two ends of the member 233. These shoulders are inclined transversely of the frame in opposite directions, the two conical heads also being applied against these shoulders in opposite directions under the action of regulating handwheels 243. The member 233 does not bear directly on the vertical members 231 and 232 but on adjusting screws 244 integral with these vertical members. Each one of the four members of the pressure-applying frame carries one or more plates 245 adapted to bear against the sealing means 228, these plates being fixed to a number of shoes 246 integral with rods which are adjustably slidable in sleeves 247 fixed to and extending through the members 230 to 233 of the frame 229.

With regard to the spreading device 227, it comprises a single member 278 similar to the member 178 of the first embodiment, this member being adapted to be engaged in the longitudinal cavity 107 between the voussoirs in the same way as in the first embodiment and under the effect of the force exerted by the sealing means 228.

This jig is employed in the following manner:

The ball blocks are first adjusted. The ball blocks constituting the web support means 223 are adjusted by screwing the tubes 198 in the tubes 197 in such manner that all of the eight (or six) points of contact of the balls pertain to the same cylindrical surface which must be the outer surface of the panel. The blocks constituting the bearing means 224 and aligning means 224$^a$ for the walls of the voussoirs are also adjusted in such manner as to embody, in one case, a support line, and, in the other, an alignment plane. The blocks of the bearing means of the pivotable series 217$^b$ are also adjusted in such manner as to embody a line which, as soon as the stops 205 are in bearing relation, constitute with the line of blocks of the fixed series 217$^a$ the exact dimension required for the panel in the circumferential direction.

The lateral frame 194$^a$–195$^a$ being open under the effect of the extension of the cylinder device 202, the voussoirs 219 and 220 are then placed in position so that they are supported by the blocks 223 and are aligned on the blocks 224$^a$, the voussoir 219 moreover bearing against the blocks 224. Owing to the inclination of the chassis 182, the voussoirs bear and align themselves on these blocks merely under the effect of their weight. The cylinder device 202 is then retracted so that the ball blocks 217$^b$ assume the desired position with a suitable absorption of shocks by the stops 205. The spreading member 278 is then disposed in the cavity 107 between two voussoirs and the sealing means 228 and its frame 229 are closed with a clamping effect achieved by means of the handwheels 243. This clamping is sufficient to force the member 278 into the cavity and cause it to perform its function as a spreading means applying the two voussoirs 219 and 220 respectively against the bearing ball blocks of the series 217$^a$ and 217$^b$. This clamping moreover ensures a perfect application of the plates 245 and consequently of the sealing means 228 against the voussoirs. Note that the adjusting screws 244 prevent by their position an excessive clamping of the frame and, moreover, the clamping of the latter has all the desirable independance of the chassis owing to the fact that its lower member 230 is solely guided between the tabs 236 and 237.

This sealed application of the sealing means combined with the spreading apart of the voussoirs thus provides between the adjacent walls of the latter a single cavity which is then filled with a connecting material in a manner similar to that of the first embodiment. As soon as the two voussoirs are rendered interconnected by means of this material, the pre-assembled panel may be withdrawn from the jig after tilting the ball blocks 217$^b$ under the effect of an extension of the cylinder device 202. Note in this respect the interest of this pivoting arrangement from the point of view of both the positioning of the voussoirs and the withdrawal of the assembled panel, the longitudinal ends of the voussoirs and of the panel encountering no obstacle in these operations.

Note, moreover, that the ball blocks 224$^a$ are provided only on one of the transverse sides of the panel 221 whereas two series 118$^a$ and 118$^b$ thereof were provided on each side of the panel in the first embodiment described hereinbefore. This simplification results from the fact that the panel has only a single voussoir in the longitudinal direction of the lining so that, owing to the allowed voussoir casting tolerances, it will be in any case necessary to proceed to a surfacing of one of the transverse sides of the panel, which explains the possibility of not providing bearing means on this side.

Another result of the foregoing is that, in the second embodiment, the ball blocks 224$^a$ perform solely a function of aligning the two voussoirs whereas in the first embodiment the ball blocks 124 of the series 118$^a$ and 118$^b$ perform the function of bearing means.

Having now described my invention what I claim as new and desire to secure by Letters Patent is:

1. A method for constructing a bore lining from elementary voussoirs comprising pre-assembling the voussoirs into panels in the factory by means of a voussoir connecting material interposed between the voussoirs and capable of maintaining the voussoirs assembled, each one of the panels comprising at least two voussoirs which are in adjacent relation and interconnected by said connecting material in at least one of circumferential and axial directions and, after transfer of the panels to the construction site, directly laying the pre-assembled panels in the bore so as to form the lining, the pre-assembly of said two voussoirs comprising starting with two voussoirs whose lengths in said one direction are such that if the two voussoirs were put in direct contact with each other in said one direction the outside dimension of the two contacting voussoirs would be less than the desired outside dimension of the panel, placing said two voussoirs in adjacent relation in said one direction in a jig comprising two opposed bearing means which are capable of defining the desired outside dimension for the panel in said one direction, said two voussoirs being brought into contact with said bearing means and the panel being brought to the desired outside dimension in said one direction by interposition of voussoir-separating means between said two voussoirs so as to urge said two voussoirs in said one direction against said two bearing means, and interposing said connecting material in a gap formed between said two voussoirs thus urged against said two bearing means.

2. A method as claimed in claim 1, wherein the connecting material comprises hardenable adhesive.

3. A method as claimed in claim 2, wherein the adhesive is injected between the voussoirs after placing the voussoirs in contact with said bearing means.

4. A method as claimed in claim 1, wherein the connecting material comprises bands of adhesive cement capable of hardening.

5. A method as claimed in claim 2, wherein the connecting material comprises bands of compressible material capable of hardening.

6. A method as claimed in claim 2, comprising, after the adhesive has been applied and has hardened, completing the assembly of the voussoirs by a bolting of the voussoirs.

7. A method as claimed in claim 1, wherein the connecting material comprises a welded joint between the two voussoirs.

8. A voussoir for assembling with other voussoirs to form a lining, comprising a web having the general shape of a portion of a cylinder, a rectangular frame having walls integral with the web and substantially perpendicular to the web, a pair of said walls being parallel walls extending circumferentially of said cylinder and a pair of said walls being parallel walls extending axially of said cylinder, a first groove which is provided in at least one wall of each of said parallel pairs of said walls of the frame and is substantially parallel to said cylinder for receiving connecting material which is also a filling material for interconnecting the voussoirs, and a substantially radially extending second groove which is provided in each of the walls provided with the first groove and puts an outer edge of the wall remote from the web in communication with the first groove.

9. A voussoir as claimed in claim 8, for acting as a centre voussoir or as a voussoir adjacent the centre voussoir in the direction circumferentially of said cylinder, wherein at least one of said walls which extends axially of said cylinder has a first aperture, a second aperture, a key which has a cranked portion extending through the second aperture and outwardly beyond said one of said walls keying engagement with a neighboring voussoir, and a second portion bearing flat against one wall and defining a third aperture, and a bolt extending through the third aperture and the first aperture for holding the key in position and for engaging in an aperture in said neighbouring voussoir.

10. A voussoir as claimed in claim 8, wherein at least one of the circumferential walls has at a free end of the wall remote from the web a set-back surface.

11. A voussoir as claimed in claim 8, wherein at least one of its axial walls has at a free end of the wall remote from the web a portion of a set-back surface.

12. A method for constructing a bore lining from elementary voussoirs comprising pre-assembling the voussoirs into panels in the factory by means of a voussoir connecting material interposed between the voussoirs and capable of maintaining the voussoirs assembled, each one of the panels comprising at least two voussoirs which are in adjacent relation and interconnected by said connecting material in at least one circumferential and axial directions and, after transfer of the panels to the construction site, directly laying the pre-assembled panels in the bore so as to form the lining, the pre-assembly of said two voussoirs comprising starting with two voussoirs whose lengths in said one direction are such that if the two voussoirs were put in direct contact with each other in said one direction, the outside dimension of the two contacting voussoirs would be less than the desired outside dimension of the panel, placing the two voussoirs in adjacent relation in said one direction in a jig comprising two opposed bearing means which are capable of defining the desired outside dimension of the panel in said one direction, and producing, with the aid of means interposed between the two voussoirs and capable of urging the two voussoirs apart such distance that said outside dimension exceeds said desired outside dimension, a relative movement between the two voussoirs and said two bearing means in said one direction so as to apply the two voussoirs against said two bearing means when said two bearing means define said desired outside dimension, said connecting material being interposed between the two voussoirs.

13. A method as claimed in claim 12, wherein said means interposed between the two voussoirs are of elastically yieldable material whereby the two voussoirs are yieldingly applied against the two bearing means.

14. A method as claimed in claim 1, comprising applying sealing means against the two voussoirs to close the interior of the gap from the exterior and injecting said connecting material into the interior of the gap through a single orifice.

15. A method for constructing a bore lining from elementary voussoirs comprising pre-assembling the voussoirs into panels in the factory by means of a voussoir connecting material interposed between the voussoirs and capable of maintaining the voussoirs assembled, each one of the panels comprising at least two voussoirs which are in adjacent relation and interconnected by said connecting material in at least one of circumferential and axial directions and, after transfer of the panels to the construction site, directly laying the pre-assembled panels in the bore so as to form the lining, the pre-assembly of said two voussoirs comprising starting with two voussoirs whose lengths in said one direction are such that if the two voussoirs were put in direct contact with each other in said one direction, the outside dimension of the two contacting voussoirs would be less than the desired outside dimension of the panel, placing the two voussoirs in adjacent relation in said one direction in a jig comprising two opposed bearing means which are relatively movable to a position for defining the desired outside dimension for the panel in said one direction, relatively moving said two bearing means to said position for defining said desired outside dimension for the panel, interposing between the two voussoirs voussoir-separating means to urge the voussoirs against the two bearing means in said position of the bearing means and interposing said connecting material in a gap formed between the two voussoirs upon application of the voussoirs against the bearing means.

* * * * *